US012275504B1

(12) United States Patent
Donnelly

(10) Patent No.: US 12,275,504 B1
(45) Date of Patent: Apr. 15, 2025

(54) MARINE VESSELS HAVING A MODIFIABLE WAKE AND DEVICES FOR MODIFYING A WAKE OF A MARINE VESSEL

(71) Applicant: Brunswick Corporation, Mettawa, IL (US)

(72) Inventor: Kevin J. Donnelly, Edgewater, FL (US)

(73) Assignee: Brunswick Corporation, Mettawa, IL (US)

( * ) Notice: Subject to any disclaimer, the term of this patent is extended or adjusted under 35 U.S.C. 154(b) by 561 days.

(21) Appl. No.: 17/665,197

(22) Filed: Feb. 4, 2022

(51) Int. Cl.

| | |
|---|---|
| ***B63B 1/28*** | (2006.01) |
| ***B63B 7/02*** | (2020.01) |
| ***B63B 34/70*** | (2020.01) |
| ***B63B 34/75*** | (2020.01) |

(52) U.S. Cl.
CPC ..... *B63B 7/02* (2013.01); *B63B 1/28* (2013.01); *B63B 34/70* (2020.02); *B63B 34/75* (2020.02)

(58) Field of Classification Search
CPC .. B63B 7/02; B63B 1/28; B63B 34/70; B63B 34/75
See application file for complete search history.

(56) References Cited

U.S. PATENT DOCUMENTS

| | | | | |
|---|---|---|---|---|
| 6,138,601 | A | 10/2000 | Anderson et al. | |
| 6,520,104 | B1 * | 2/2003 | Svensson | B63B 39/061 114/144 R |
| 7,188,581 | B1 | 3/2007 | Davis et al. | |
| 8,113,892 | B1 | 2/2012 | Gable et al. | |
| 8,539,897 | B1 | 9/2013 | Gasper et al. | |
| 8,833,286 | B1 | 9/2014 | Sheedy et al. | |
| 9,278,740 | B1 | 3/2016 | Andrasko et al. | |
| 9,315,235 | B1 | 4/2016 | Wood | |
| 9,359,057 | B1 | 6/2016 | Andrasko et al. | |
| 9,611,006 | B1 * | 4/2017 | Miller | B63B 1/08 |
| 10,040,522 | B1 | 8/2018 | Hartman et al. | |
| 10,137,971 | B2 | 11/2018 | Andraso et al. | |
| 2017/0038771 | A1 | 2/2017 | Green et al. | |
| 2021/0354793 | A1 * | 11/2021 | Wang | B63B 34/75 |

* cited by examiner

*Primary Examiner* — Anthony D Wiest
(74) *Attorney, Agent, or Firm* — Andrus Intellectual Property Law, LLP

(57) ABSTRACT

A device for modifying a wake of a marine vessel hull. The hull extends between a bow and a transom and laterally between sides. An underside of the hull extends between the sides and between the bow and the transom. The device includes an appendage with a first panel fixed to a second panel. The appendage is configured to be movably coupled to the hull to move between a stowed position and a deployed position. In the stowed position the first panel extends along one of the sides of the hull and the second panel extends along the underside of the hull. The first panel moves laterally outwardly away from the side of the hull and the second panel moves vertically away from the underside of the hull when the appendage moves toward the deployed position. Moving the appendage to the deployed position modifies the wake of the marine vessel.

20 Claims, 14 Drawing Sheets

MARINE VESSELS HAVING A MODIFIABLE WAKE AND DEVICES FOR MODIFYING A WAKE OF A MARINE VESSEL

FIELD

The present disclosure generally relates to marine vessels having a modifiable wake and devices for modifying a wake of a marine vessel.

BACKGROUND

The following U.S. patents provide background information and are incorporated by reference in entirety.

U.S. Pat. No. 10,137,971 discloses a trim control system that automatically controls trim angle of a marine propulsion device with respect to a vessel. A memory stores trim base profiles, each defining a unique relationship between vessel speed and trim angle. An input device allows selection of a base profile to specify an aggressiveness of trim angle versus vessel speed, and then optionally to further refine the aggressiveness. A controller then determines a setpoint trim angle based on a measured vessel speed.

U.S. Pat. No. 9,359,057 discloses a system for controlling movement of drive units on a marine vessel with a control circuit connected to each drive unit. When the marine vessel is turning, the control circuit defines one of the drive units as an inner drive unit and another of the drive units as an outer drive unit. The control circuit calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel is turning.

U.S. Pat. No. 9,278,740 discloses a system for controlling an attitude of a marine vessel having first and second trim tabs, which includes a controller having vessel roll and pitch control sections. The pitch control section compares an actual vessel pitch angle to a predetermined desired vessel pitch angle and outputs a deployment setpoint that is calculated to achieve the desired pitch angle. The roll control section compares an actual vessel roll angle to a predetermined desired vessel roll angle, and outputs a desired differential between the first and second deployments that is calculated to maintain the vessel at the desired vessel roll angle. When the controller determines that the magnitude of a requested vessel turn is greater than a first predetermined threshold, the controller decreases the desired differential between the first and second deployments, and accounts for the decreased desired differential deployment in its calculation of the first and second deployments.

U.S. Pat. No. 8,113,892 discloses a marine propulsion control system that receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

U.S. Pat. No. 7,188,581 discloses a marine drive, a marine vessel, and drive combination have a trim tab with a forward end pivotally mounted to a marine propulsion device.

U.S. Pat. No. 6,138,601 discloses a Vee bottom planing boat hull with right and left steps positioned so as to optimize the boat's trim angle at top speed, and defining right and left notches in which are pivotally mounted left and right trim tabs having forward leading edges along oblique pivot axes causing outer corners of trailing edges of the trim tabs to move downwardly more than inner corners during downward pivoting of the trim tabs. This provides an active hull to control boat trim angle and effectively reduce deadrise angle while maintaining a running surface trailing edge substantially free of discontinuities in the vertical direction.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a device for modifying a wake of a marine vessel having a hull. The hull extends between a bow and a transom in a longitudinal direction and between sides in a lateral direction perpendicular to the longitudinal direction. The sides extend between a top and a bottom in a vertical direction that is perpendicular to the longitudinal direction and perpendicular to the lateral direction, where an underside of the hull extends between the sides and between the bow and the transom. The device includes an appendage having a first panel and a second panel, the first panel being fixed relative to the second panel. The appendage is configured to be movably coupled to the hull, movable into and between a stowed position and a deployed position such that in the stowed position the first panel extends along one of the sides of the hull and the second panel extends along the underside of the hull. The first panel moves laterally outwardly away from the one of the sides of the hull and the second panel moves vertically away from the underside of the hull when the appendage moves toward the deployed position. Moving the appendage from the stowed position to the deployed position causes the appendage to modify the wake of the marine vessel.

Another embodiment generally relates to a marine vessel having a modifiable wake. The marine vessel includes a hull that extends between a bow and a transom in a longitudinal direction and between sides in a lateral direction perpendicular to the longitudinal direction. The sides each extend between a top and a bottom in a vertical direction that is perpendicular to the longitudinal direction and perpendicular to the lateral direction. An underside of the hull extends between the sides and between the bow and the transom. An appendage has a first panel and a second panel, the first panel being fixed relative to the second panel. The appendage is pivotally coupled to the hull. An actuator is operable to pivot the appendage about a pivot axis into and between a stowed position and a deployed position. In the stowed position, the first panel extends along one of the sides of the hull and the second panel extends along the underside of the hull. A centerline laterally bisects the hull between the bow and the transom. The pivot axis extends at an angle between 35 and 55 degrees from the centerline such that the first panel moves laterally outwardly away from the one of the sides of the hull and the second panel moves vertically away from the underside of the hull when the appendage moves toward the deployed position. Moving the appendage from the stowed position to the deployed position causes the appendage to modify the wake of the marine vessel. The actuator is at least partially positioned longitudinally forward of the transom. Recesses are formed in the one of the sides and in the underside of the hull. The appendage is configured such that the first panel and the second panel are each at least partially positioned in the recesses in the one of the sides and in the underside, respectively, when in the stowed position.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

Figure 1:
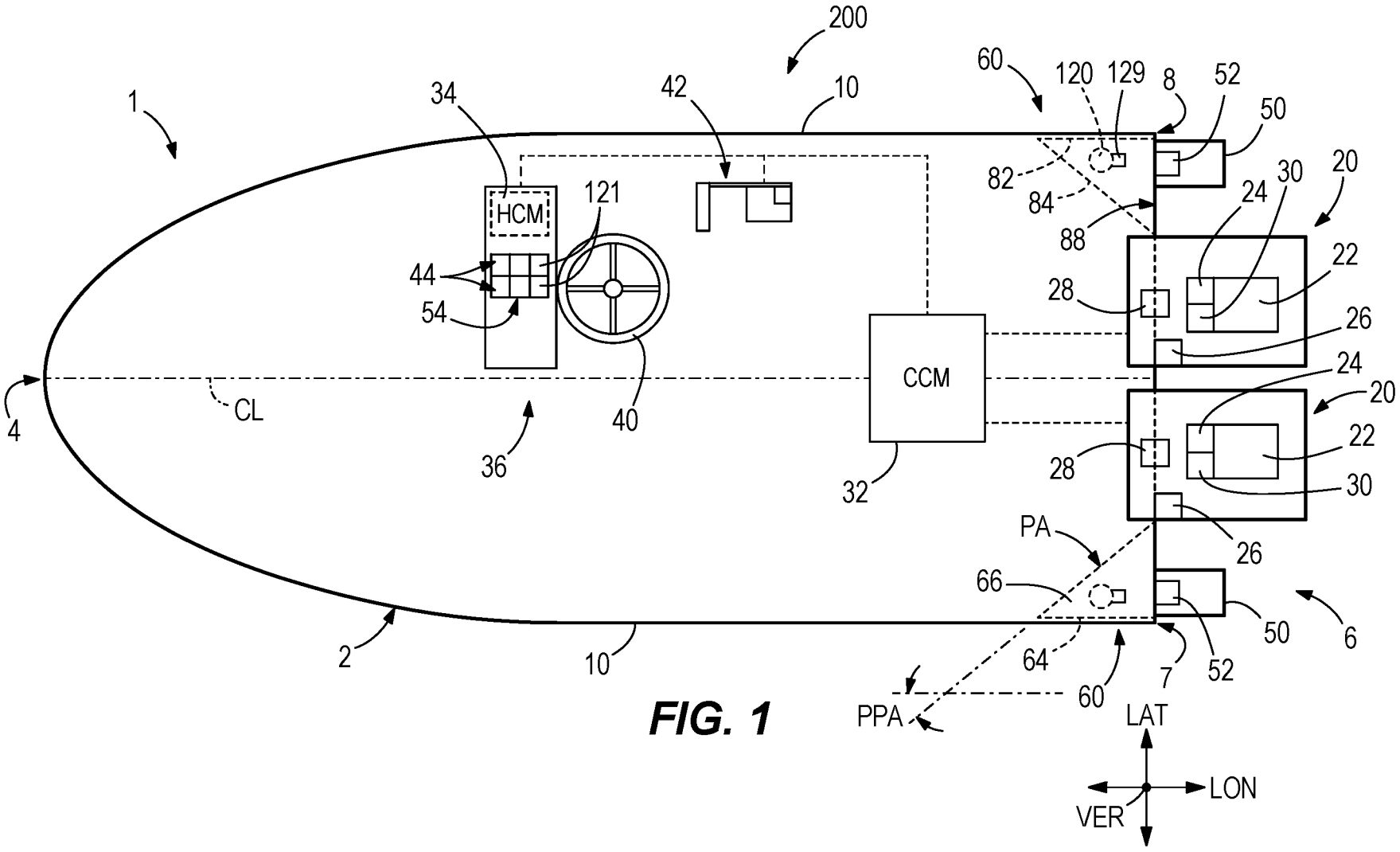
FIG. 1 is an overhead schematic view of a marine vessel having devices for modifying a wake according to the present disclosure.
Figure 2:
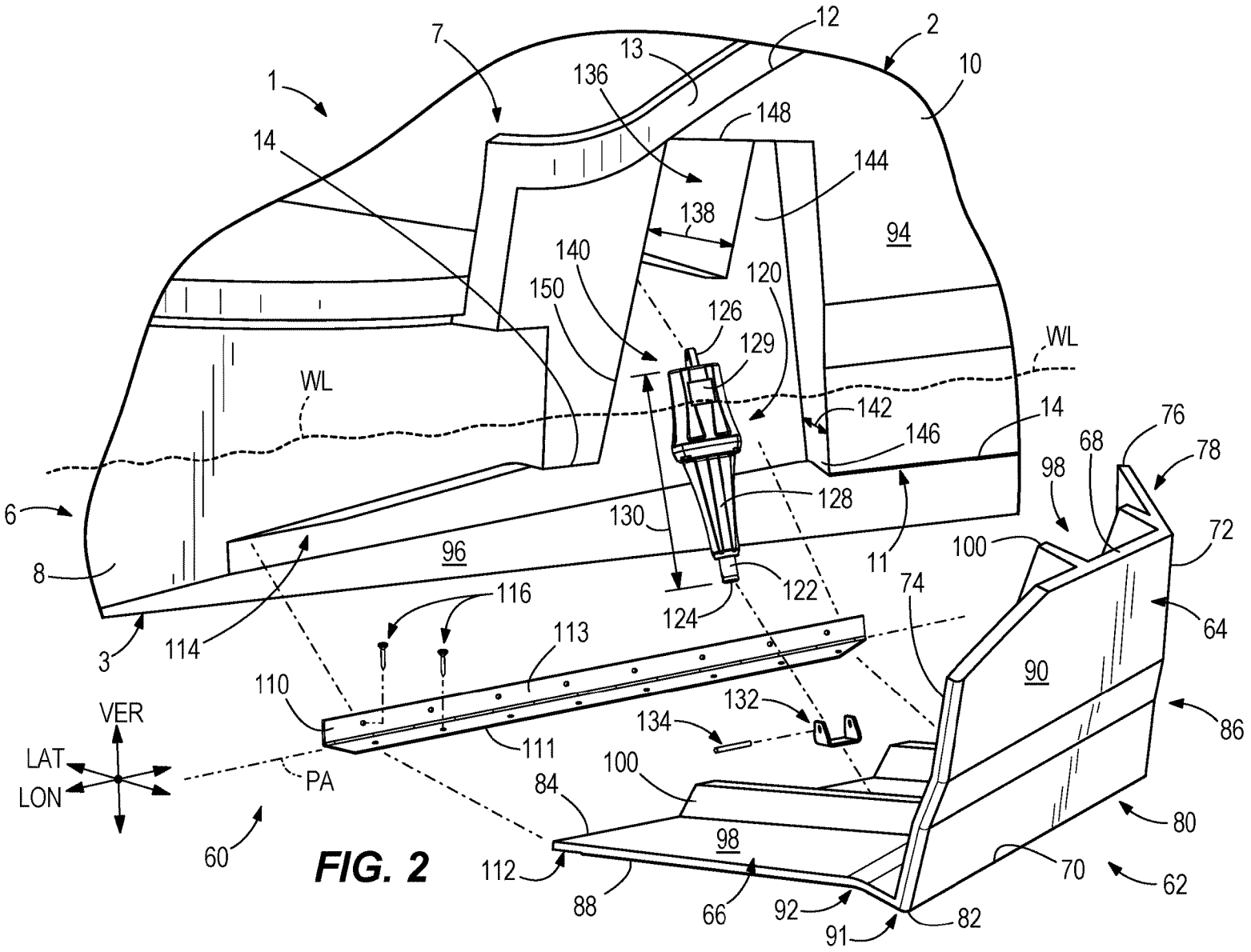
FIG. 2 is an exploded rear perspective view of one embodiment of device according to the present disclosure.

The present disclose relates to marine vessels having a modifiable wake, and devices for modifying a wake of a marine vessel, such as to create a surfable wake behind the marine vessel for wake surfing. FIG. 1 depicts a marine vessel 1 having a hull 2 that extends in a longitudinal direction between a bow 4 and a stern 6 with a transom 8 located at the stern 6. The hull 2 further extends between sides 10 in a lateral direction that is perpendicular to the longitudinal direction. As shown in FIG. 2, the sides 10 of the hull 2 each extend between a top 12 and a bottom 14 in a vertical direction that is perpendicular to both the longitudinal direction and perpendicular to the lateral direction. A rub rail 13 is provided above the top 12 of the hull 2 in a conventional manner. Undersides 3 of the hull 2 extend vertically downwardly and laterally inwardly from the bottoms 14 of the sides 10. The undersides 3 meet at a keel that extends longitudinally along a centerline CL (see FIG. 1) between the bow 4 and the stern 6.

The marine vessel 1 is provided with a propulsor 20, which in the case of a surf boat is typically an inboard or a stern drive. However, as will be discussed further below, the presently disclosed systems and methods may also provide the possibility of incorporating more than one propulsor, and/or using outboard propulsors, if desired. The marine vessel 1 of FIG. 1 includes two propulsors 20 each configured to generate thrust to propel the marine vessel 1 through water in a conventional manner. The two propulsors 20 each have a powerhead 22 (e.g., an electric motor, an internal combustion engine, or a hybrid thereof) coupled in a torque-transmitting relationship with a propeller (not shown) to propel the marine vessel 1 in a manner known in the art. The two propulsors 20 are presently shown as outboard motors, but could alternatively be inboard motors, stern drives, pod drives, outboard motors having steerable gearcases (such as disclosed in U.S. Pat. No. 10,800,502, which is incorporated herein in its entirety), jet drives, and/or any other devices configured to propel a marine vessel 1. The powerheads 22 are operated via a "drive-by-wire" control system such as described in U.S. Pat. No. 7,941,253, which is incorporated by reference herein in its entirety. Each propulsor 20 further includes a powerhead speed sensor 24 (e.g., a Hall-effect sensor) that measures the rotational speed of the powerhead 22 in rotations per minute (RPM) in a manner known in the art.

The propulsors 20 are steerable via steering actuators 26 as a "steer-by-wire" system in a manner known in the art, for example via electric motors, hydraulic actuators, and/or pneumatic actuators (see U.S. Pat. Nos. 7,150,664; 7,255,616; 7,467,595; and 8,113,892, which are incorporated by reference herein in their entireties). The trim angle of each of the propulsors 20 is also adjustable in a manner known in the art, specifically by control of trim actuators 28 (which may also be electric, hydraulic, and/or pneumatic as described in U.S. Pat. No. 10,137,971, which is incorporated by reference herein in its entirety). Each propulsor 20 also includes an engine control module 30 (ECM 30) that receives signals for operating the propulsors 20 in a manner known in the art, including the powerhead 22, the steering actuators 26, and trim actuators 28. For clarity, the term engine control module 30 is used even where the powerhead 22 does not include an internal combustion engine.

With continued reference to FIG. 1, the engine control modules 30 each communicate with a central control module 32 (CCM 32), with the central control module 32 also communicating with a helm control module 34 (CHM 34) at a helm 36 of the marine vessel 1 in a conventional manner. Additional information regarding these elements, which together form a control system 200, is provided below.

The helm 36 includes a number of operator input devices through which an operator can input commands for controlling the marine vessel 1. These commands are received by the HCM 34 and communicated to the CCM 32 for controlling the ECMs 30 in the propulsors 20. The helm 36 of FIG. 1 includes a steering device, such as a steering wheel 40, which inputs steering commands for operating the steering actuators 26 to steer the marine vessel 1 in a manner known in the art. A throttle lever 42 is operable for providing thrust commands for the powerheads 22, including both a magnitude and a direction of thrust. The helm 36 further includes trim controls 44 (e.g., rocker switches or touchscreen controls) for adjusting the trim angles of the propulsors 20 via the trim actuators 28 in a manner known in the art.

The marine vessel 1 of FIG. 1 is further provided with conventionally known trim tabs 50 that are operable to adjust the lift and/or roll of the marine vessel 1 when underway. The trim tabs 50 extend longitudinally rearwardly from the transom 8 and are adjustable via trim tab actuators 52, which may be electric, pneumatic, and/or hydraulically actuated in a manner known in the art. Additional information regarding trim tabs presently known in the art is provided in the background patents incorporated by reference above. Control of the trim tab actuators 52 is provided via trim tab controls 54 at the helm 36 (e.g., rocker switches or touchscreen controls), which allow the operator to adjust the positions of the trim tabs 50 together or independently.

With reference to FIG. 2, the present inventor has developed the presently disclosed devices 60 for modifying the wake of a marine vessel 1. A device 60 is provided for each of the sides 10 of the marine vessel 1, which allows for selectively modifying the wake on either side 10 of the marine vessel 1 as needed. For clarity, the present disclosure primarily describes a single device 60 individually. Such description is equally applicable to the other device 60. The devices are essentially mirror images of each other. Each device 60 includes an appendage 62 formed of fiberglass, plastics, aluminum, steel, metal alloys, or other materials such as those used for producing hulls or trim tabs, in certain embodiments being selected to match the material of the hull 2.

The appendage 62 includes a first panel 64 and a transversely extending second panel 66 that are rigidly fixed together. The first panel 64 and the second panel 66 are referred to as being fixed together whether they are formed together or subsequently coupled together. The first panel 64 extends between a top edge 68 and an opposite bottom edge 70, and between a first edge 72 and an opposite second edge 74. The first edge 72 and the second edge 74 are also referred to herein as the forward edge and the aft edge, respectively. The first panel 64 of FIG. 2 extends further away from the second edge 74 past the first edge 72 to a third edge 76. The portion of the first panel 64 between the first edge 72 and the third edge 76 is also referred to as a forward portion 78 and the portion between the forward edge and the second edge 74 is also referred to as an aft portion 80. The top edge 68 of the first panel 64 within the forward portion 78 is angled relative to the top edge 68 within the aft portion 80.

With continued reference to FIG. 2, the second panel 66 extends between a first edge 82 and a second edge 84, and between a third edge 86 and a fourth edge 88. The bottom edge 70 of the first panel 64 is fixed to the first edge 82 of the second panel 66, such as through integral formation of the first panel 64 and the second panel 66, or through subsequent coupling in a manner known in the art (e.g., welding and/or fasteners).

An outer surface 90 of the first panel 64 (particularly within the aft portion 80) is shaped to correspond to an outer surface 94 of the side 10 of the hull 2, in certain embodiments with the outer surface 90 and the outer surface 94 being flush. Likewise, an outer surface 92 of the second panel 66 is shaped to correspond to an outer surface 96 of the underside 3 of the hull 2. The contours of the outer surfaces 90, 92, 94, and/or 96 may be provided for aesthetic and/or functional purposes, for example forming a chine 91 on the appendage 62 corresponding to a chine 11 on the hull 2. In certain embodiments, the top edge 68 extends more than 7 inches above the chine 91, such as being between 12 and 24 inches above the chine 91. Inner surface 98 of the first panel 64 and the second panel 66 are each provided with ribs 100, which provide rigidity for the appendage 62, including between the first panel 64 and the second panel 66.

With continued reference to FIG. 2, the appendage 62 is movably coupled to the hull 2 via a hinge 110 (e.g., a piano-type hinge), which is pivotable about a pivot axis PA. In particular, a first side 111 of the hinge 110 is coupled to the appendage 62 via fasteners 116 (e.g., screws or rivets) that extend through openings in the hinge 110 and engage the second panel 66 of the appendage 62. In particular, a shelf 112 is formed in the outer surface 92 of the second panel 66. The shelf 112 is configured such that when the first side 111 of the hinge 110 is positioned on the shelf 112, the hinge 110 is flush with the outer surface 92 of the second panel 66. An opposite second side 113 of the hinge 110 is coupled to the hull 2, and specifically at a face 114 within the underside 3 of the hull 2. The second side 113 of the hinge 110 may be coupled to the underside 3 of the hull 2 via fasteners 116 such as those used for coupling the first side 111. In this manner, the appendage 62 is coupled to the hull 2 via the hinge 110 so as to be pivotable between a stowed position and a deployed position as discussed further below. It should be recognized that other techniques for coupling the hinge 110 to the appendage 62 and/or to the hull 2 are also contemplated by the present disclosure, including welding, adhesives, and/or integral formation.

As shown in FIG. 1, the hinge 110 is coupled to the hull 2 such that the pivot axis PA is at an angle PAA relative to the centerline CL of the hull 2 that extends between the bow 4 and the stern 6. In other words, the angle PAA is non-parallel and non-perpendicular to the centerline CL. In certain embodiments, the angle PAA is between 20 and 70 degrees, between 35 and 55 degrees, or between 40 and 50 degrees.

Returning to FIG. 2, the device 60 further includes an actuator 120, here a linear actuator, coupled to the appendage 62 and to the hull 2. The actuator 120 has a rod 122 with a first end 124 that extends away from a second end 126 of a housing 128 by a distance 130. A clevis bracket 132 is coupled to the inner surface 98 of the second panel 66 of the appendage 62, such as through fasteners, welds, and/or rivets. The first end 124 of the actuator 120 is pivotally coupled to the clevis bracket 132 via a fastener 134 (e.g., a bolt or rivet) that extends through both the first end 124 and the clevis bracket 132. Similar structures may be used for coupling the second end 126 of the actuator 120 to the hull 2 (e.g., clevis brackets and pins), as discussed further below. It should be recognized that other mechanisms for coupling the actuator 120 to the appendage 62 and/or to the hull 2 are also contemplated by the present disclosure, including coupling the actuator 120 to the appendage 62 in other locations.

Operation of the actuator 120 changes the distance 130 between the first end 124 and the second end 126 in a manner known in the art. The linear actuator may be actuated electromechanically, pneumatically, and/or hydraulically. An example of a linear actuator available in the market is the 102 HD/XD Actuator produced by Lenco Marine (part number 15060-001). In other embodiments, a rotary actuator may be used as the actuator 120 to pivot the appendage 62 about the pivot axis PA of the hinge 110. Additional information relating to rotary actuators is provided in U.S. patent application Ser. No. 17/569,910, which is incorporated by reference herein. An example of a pneumatically operated rotary actuator is the Anodized Aluminum Vane Style Rotary Actuator produced by Speedaire, model number CRB1BW100-180S. An example of an electrically operator servo motor usable as the rotary actuator is the RDrive servo by Rozum Robotics. In this manner, operation of the actuator 120 pivots the appendage 62 about the pivot axis PA of the hinge 110. While the present disclosure further describes the use of actuators 120 below, it should be recognized that the appendage 62 may also or alternatively be manually actuated via forces provided by the operator.

With continued reference to FIG. 2, an encoder 129 within the actuator 120 measures the position of the rod 122 relative to the housing 128, and thus can be used to infer the distance 130 between the first end 124 and the second end 126. The distance 130 is used to determine the position of the appendage 62 between the deployed position and the stowed position. Moreover, the distance 130 is used to set limits for operating the actuator 120 so as to prevent moving of the appendage 62 beyond the stowed position and beyond the deployed position. In certain embodiments, the hull 2 and the appendage 62 are configured such that the appendage 62 moves between 5 and 50 degrees (pivoting about the pivot axis PA), between 10 and 30 degrees, or between 15 and 20 degrees between the stowed and deployed positions. In the configuration shown, the appendage 62 pivots approximately 20 degrees between the stowed position and the deployed position. It should be recognized that the appendage 62 may also be used in intermediate positions between the stowed position and the deployed position, which may modify the length or steepness of the wave produced by the appendage 62, and/or modify the roll, pitch, or yaw of the marine vessel 1.

Figure 5:
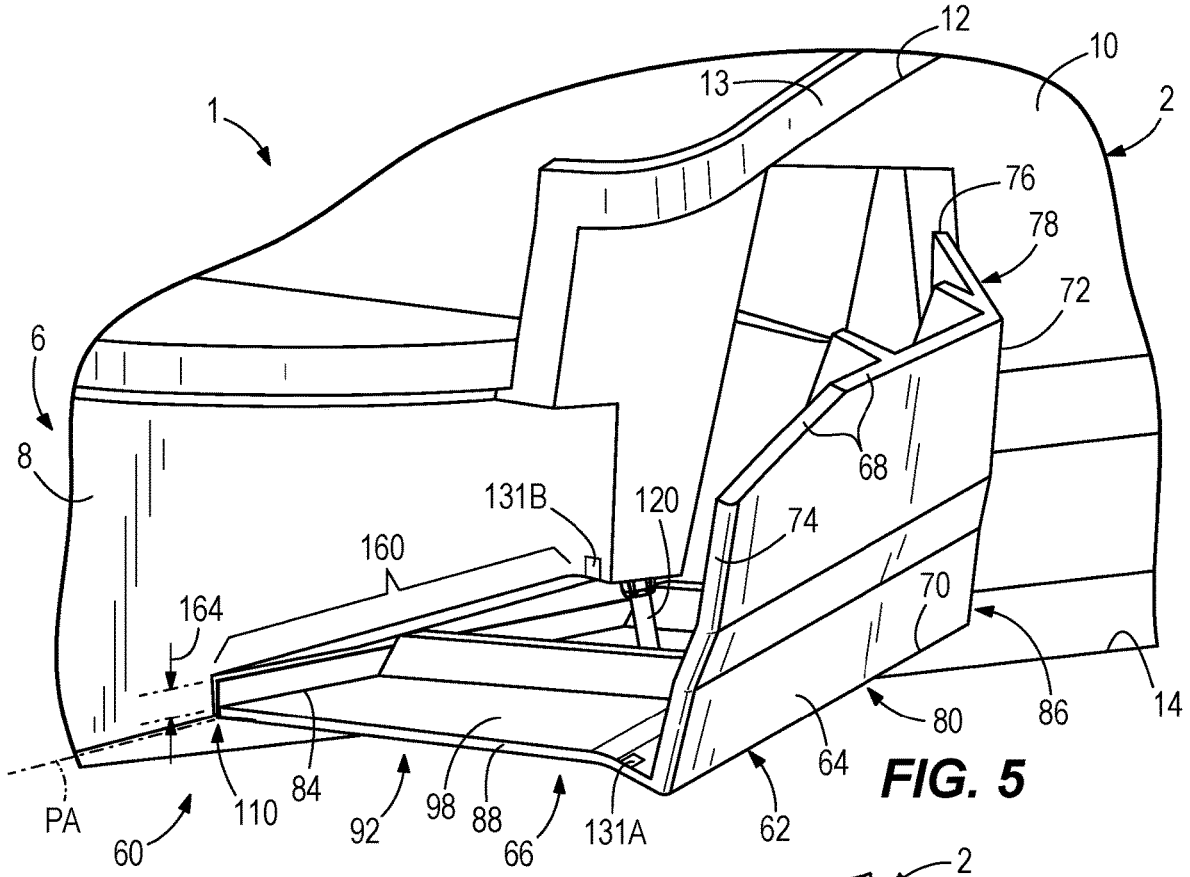
FIG. 5 is a rear perspective view of the device from FIG. 4.

Other mechanisms for determining the position of the appendage 62 are also contemplated by the present disclosure, including the use of proximity sensors between the hull 2 and the appendage 62 (e.g., a magnet 131A and detector 131B of a Hall-effect sensor such as shown in FIG. 5).

Returning to FIG. 1, the actuator 120 is controlled by appendage controls 121 at the helm 36, which may be rocker switches or touchscreen controls like the trim controls 44 discussed above. In certain embodiments, the control system 200 is configured such that a momentary actuation of one of the appendage controls 121 causes the corresponding actuator 120 to operate until the associated appendage 62 is fully in the stowed position, or fully in the deployed position, depending on the selection by the operator. As discussed above, the actuator 120 may be automatically stopped based on the position measured by the encoder 129 associated therewith.

As shown in FIG. 2. a cavity 136 is formed laterally inwardly within the side 10 of the hull 2, which is configured such that at least a portion of the actuator 120 is positioned within the cavity 136 when the second end 126 of the actuator 120 is coupled to the hull 2. The cavity 136 is positioned above the waterline WL of the marine vessel 1 to protect the actuator 120 from the elements and from impacts during operation of the marine vessel 1. The cavity 136 has a depth 138 selected such that the first end 124 of the actuator 120 remains inboard of the outer surface 94 of the side 10 of the hull 2 when the actuator 120 is retracted (with the appendage 62 correspondingly in the stowed position).

The cavity 136 extends laterally inwardly from a recess 140 that extends laterally inwardly by a distance 142 from side 10 of the hull 2. In particular, the recess 140 is formed between a base 144, a forward wall 146, a top 148, and an aft wall 150 within the hull 2. The distance 142 between the base 144 of the recess 140 and the outer surface 94 of the side 10 of the hull 2 need not be constant across the entire recess 140. As is discussed further below, the recess 140 is configured such that at least a portion of the appendage 62 is positioned within the recess 140 when the appendage 62 is in the stowed position.

Figure 3:
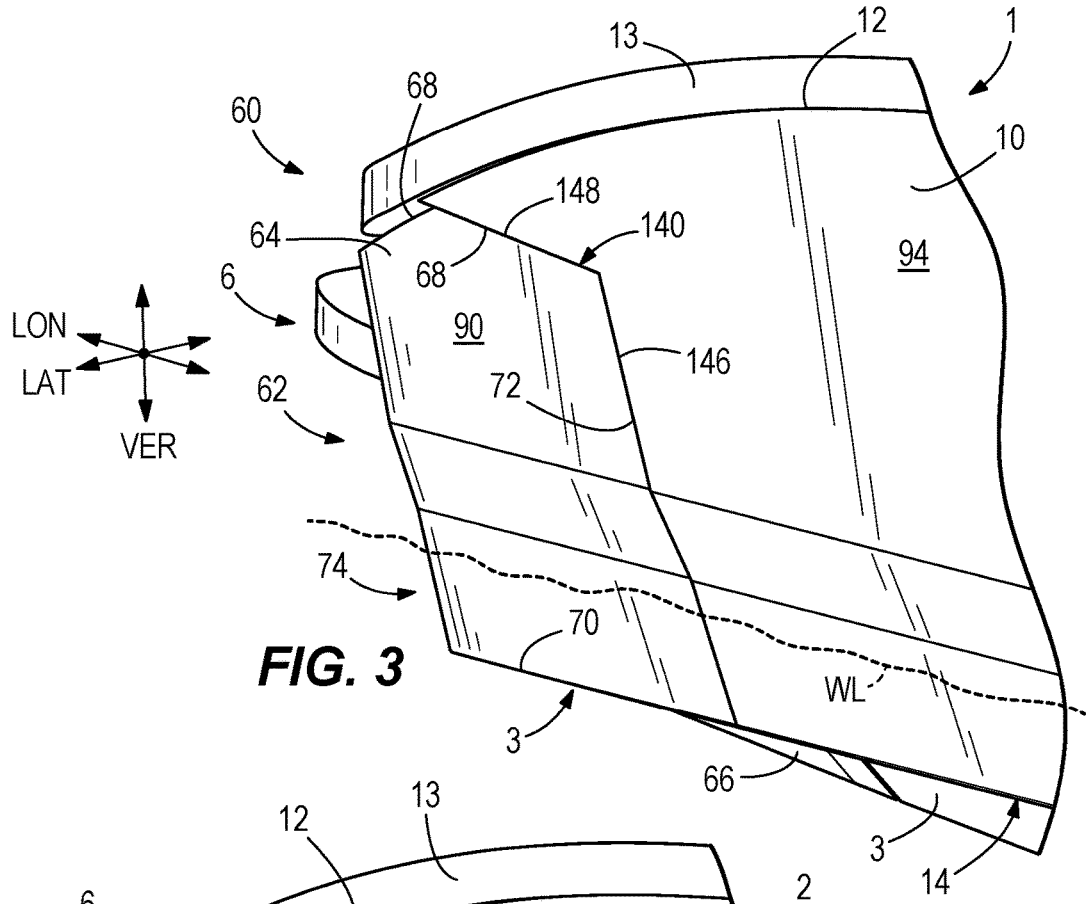
FIG. 3 is a front perspective view of the device from FIG. 2 in a stowed position.
Figure 4:
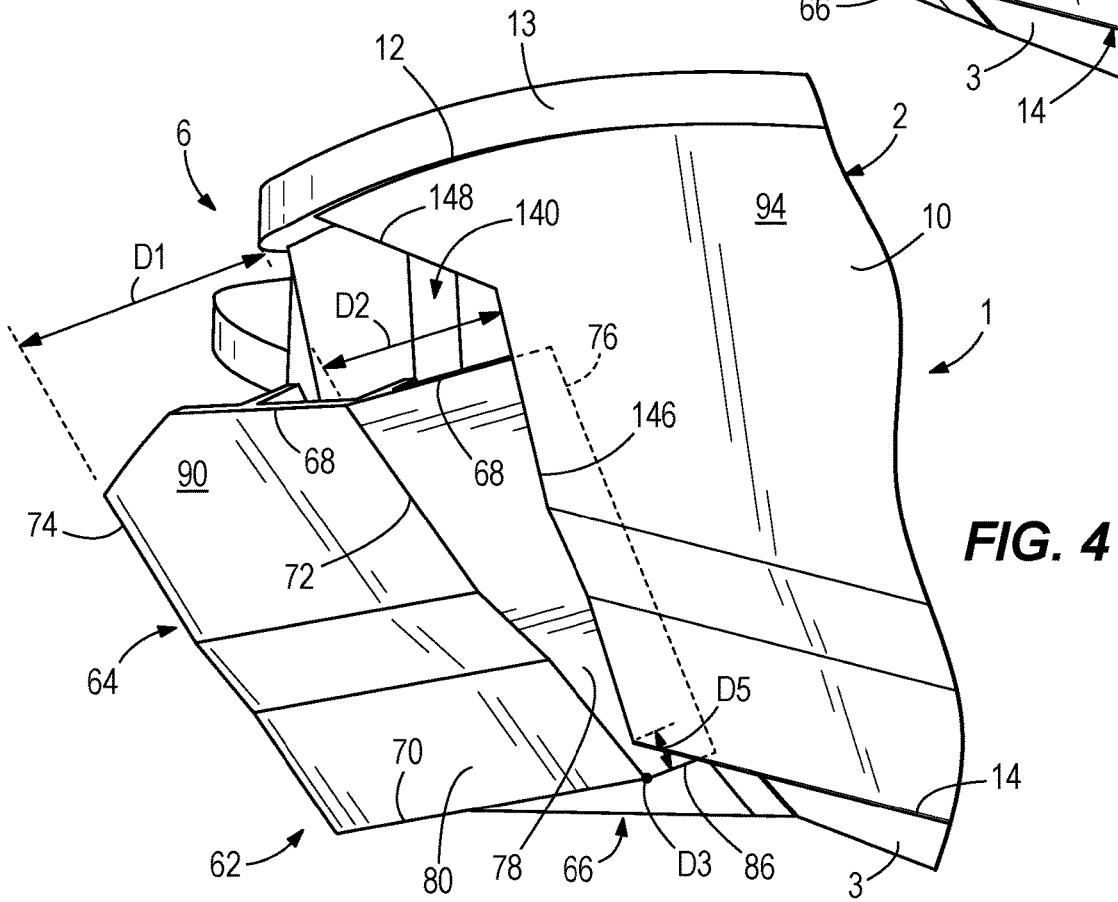
FIG. 4 is a front perspective view of the device from FIG. 2 in a deployed position.

FIGS. 3 and 4 show the appendage 62 of FIG. 2 in the stowed position, and in the deployed position, respectively. When the appendage 62 is in the stowed position of FIG. 3, the first panel 64 extends along the side 10 of the hull 2 and the second panel 66 extends along the underside 3 of the hull 2. In certain embodiments, the first panel 64 is at least partially positioned within the recess 140 in the side 10 of the hull 2 when in the stowed position, here being configured such that the outer surface 90 of the first panel 64 is flush with the outer surface 94 of the side 10 of the hull 2. The first edge 72 of the first panel 64 is aligned with the forward wall 146 of the recess 140, and the top edge 68 is aligned with the top 148 of the recess 140.

With reference to FIG. 4, when the appendage 62 is moved toward the deployed position, the first panel 64 moves laterally outwardly away from the side 10 of the hull 2 and the second panel 66 moves vertically away from the underside 3 of the hull 2. Since the pivot axis PA (FIG. 1) of the appendage 62 is angled relative to the centerline CL of the marine vessel, the lateral and vertical distances moved by the appendage 62 are greater at the second edge 74 of the appendage 62 (i.e., the edge longitudinally nearest the transom 8 of the marine vessel 1) than at the first edge 72 (which is closer to the bow). In particular, the top edge 68 moves laterally outwardly a first distance D1 at the second edge 74, which is greater than a second distance D2 laterally moved at the first edge 72, which is greater than a third distance D3 in which the bottom edge 70 of the first edge 72 laterally moves (here the third distance D3 is approximately zero).

Figure 6:
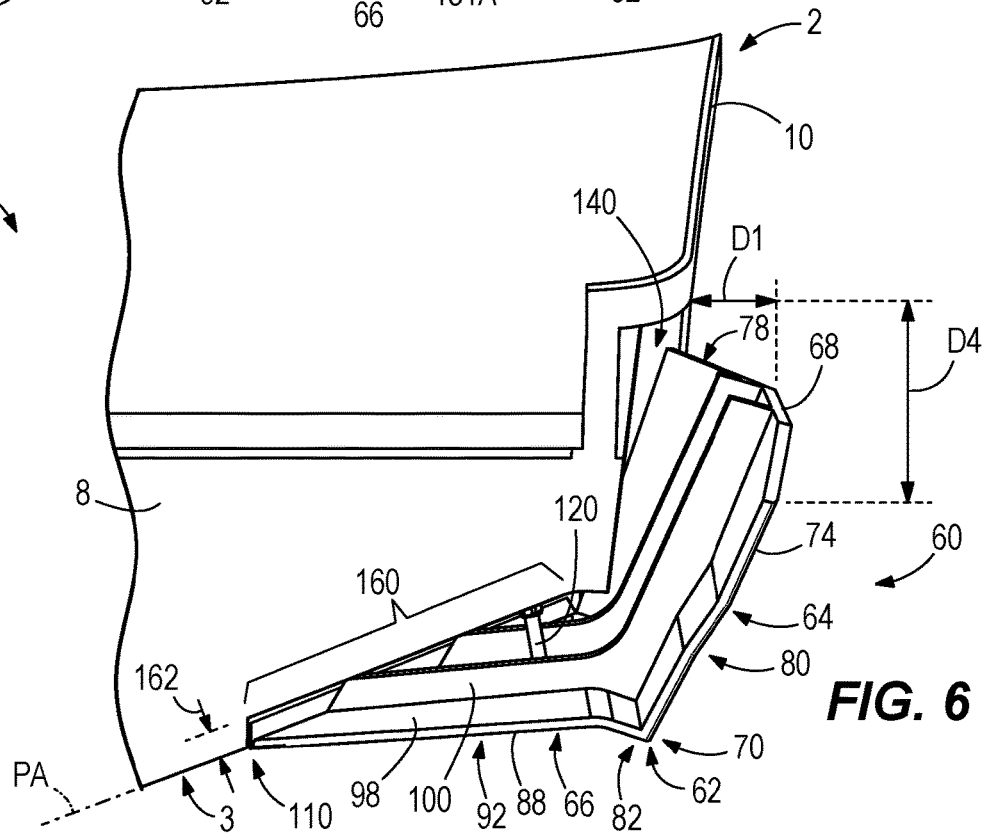
FIG. 6 is a rear view of the device from FIG. 4.

As shown in FIGS. 4 and 6, the appendage 62 also moves vertically away from the underside 3 of the hull 2 when moving from the stowed position to the deployed position. As with the lateral movement, the vertical movement of the appendage 62 is greater at the second edge 74 of the first panel 64 (nearest the transom 8) than at the first edge 72 (closer to the bow). In particular, the top edge 68 vertically moves a fourth distance D4 (FIG. 6) at the second edge 74 that is greater than a fifth distance D5 at the first edge 72 (FIG. 4).

The present inventor has recognized that by positioning the hinge 110 such that the pivot axis PA extends at an angle PAA relative to the centerline CL of the marine vessel 1 (FIG. 1), the first panel 64 can be moved laterally outwardly while simultaneously moving the second panel 66 vertically downwardly using only a single actuator 120 and a single pivot axis PA. This provides for simplified construction and installation of the device 60. Moreover, this configuration provides for a reduced cost and increased reliability due to fewer components, fewer moving parts, as fewer degrees of freedom for the moving parts.

With reference to FIG. 4, and as discussed above, the first panel 64 is further subdivided into the forward portion 78 and the aft portion 80. The device 60 is configured such that when the appendage 62 is in the deployed position, at least a portion of the forward portion 78 remains laterally inward relative to the outer surface 94 of the side 10 of the hull 2. This positioning of the forward portion 78 prevents water from flowing between the first panel 64 and the side 10 of the hull 2 when the marine vessel 1 is underway with the appendage 62 in the deployed position. Additionally, the outer surface 90 of the forward portion 78 is angled relative to the outer surface 90 of the aft portion 80. This configuration causes the forward portion 78 to divert water vertically downwardly and laterally away from the side 10 of the hull 2 (like the aft portion 80), but also to smooth the transition of the water from the side 10 of the hull 2 to the aft portion 80. However, it should be recognized that is not necessary for the forward portion 78 to divert the water or smooth the transition of the water in this manner.

FIGS. 5-6 show an additional recess 160 formed in the underside 3 of the hull 2 at the transom 8. The recess 160 has a depth 162 (FIG. 6) configured to accommodate the second panel 66 of the appendage 62, as well as the ribs 100 on the inner surface 98 of the second panel 66 (i.e., such that the outer surface 92 of the second panel 66 is flush with the underside 3 when in the stowed position). The recess 160 is further configured such that a gap 164 (FIG. 5) remains between the underside 3 of the hull 2 and the inner surface 98 of the second panel 66 when the appendage is in the stowed position. By way of example, the gap 164 may be between 0.5 and 6 inches, or between 2 and 4 inches. This gap 164 accommodates any tolerance variation between the hull 2, appendage 62, the hinge 110, and the relative positions therebetween. The gap 164 also ensures that any debris or buildup on the appendage 62 does not prevent or restrict moving the appendage 62 into the stowed position.

It should be recognized that the wake produced by the marine vessel 1 is therefore modified by the moving the appendage 62 from the stowed position of FIG. 3 to the deployed position of FIGS. 4-6. In particular, when the appendage 62 is in the deployed position, the first panel 64 and the second panel 66 each disrupt the flow of water past the hull 2 significantly more than the hull 2 itself, as is the case when the appendage 62 is stowed. The water is directed laterally outwardly away from the hull 2 due to first panel 64 extending laterally outwardly more at the second edge 74 than at the first edge 72, and due to the second panel 66 extending laterally outwardly more at the fourth edge 88 than at the third edge 86. Likewise, the flow of water is directed vertically downwardly away from the underside 3 of the hull 2 due to the first panel extending vertically downwardly more at the second edge 74 than at the first edge 72, and due to the second panel 66 extending vertically downwardly more at the fourth edge 88 than at the third edge 86.

It should further be recognized that by selectively deploying one of the appendages 62, the water flowing past the corresponding side 10 of the marine vessel 1 is delayed in converging with the water flowing past the other side 10, establishing a substantial, surfable wake. In this manner, the operator may move one appendage 62 into the deployed position (which leaving the other appendage 62 on the other side 10 of the hull 2 in the stowed position) to generate a surf wake when desired, while easily stowing both appendages 62 when the surf wake is no longer needed.

The present disclosure contemplates other configurations of hulls 2 and appendages 62, some of which are discussed further below. For example, the hull 2 need not include the recess 140 in the side 10, nor the recess 160 in the underside 3. Similarly, the recess 140 may wrap around an aft corner 7 between the side 10 and the transom 8, and/or the recess 160 may wrap around from the underside 3 to the transom 8. The recess 140 and the recess 160 may also or alternatively be connected together.

Figure 7:
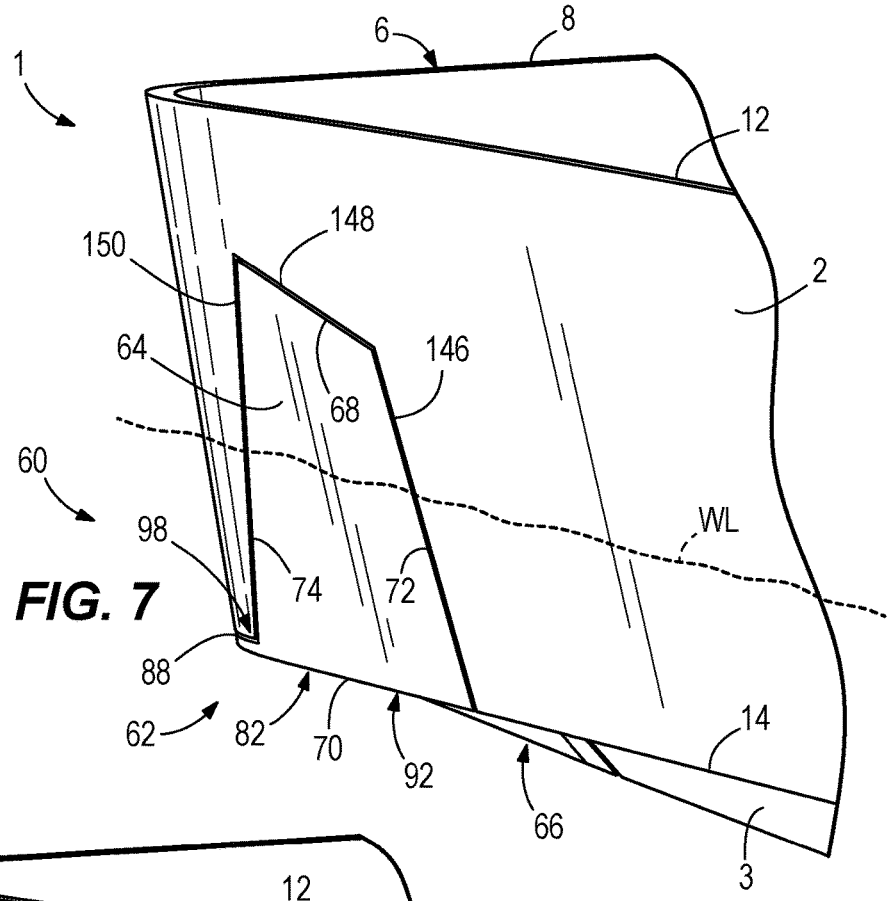
FIG. 7 is a front perspective view of another embodiment of device according to the present disclosure, shown in the stowed position.
Figure 8:
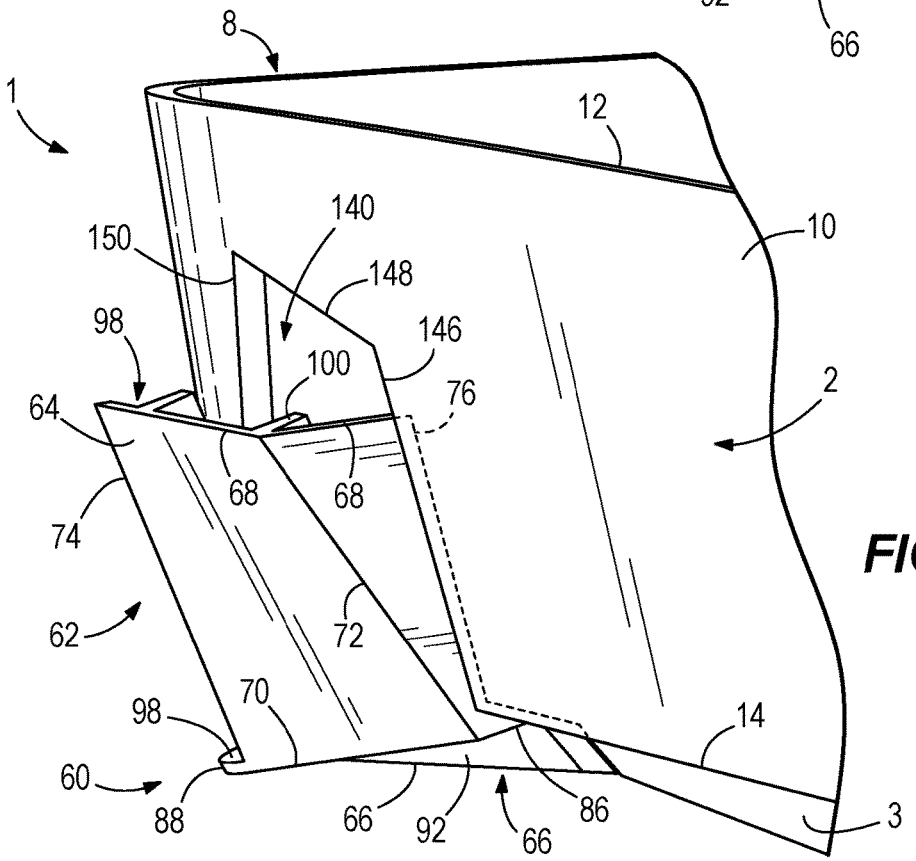
FIG. 8 is a front perspective view of the device from FIG. 7 in the deployed position.

FIGS. 7 and 8 show another embodiment of device 60 according to the present disclosure. In contrast to the embodiment of FIGS. 3 and 4, the second edge 74 of the first panel 64 is not even with the fourth edge 88 of the second panel 66. In other words, the second panel 66 extends further aft as compared to the first panel 64. Additionally, the top edge 68 of the first panel 64, and specifically where the top edge 68 meets the second edge 74, does not extend vertically upwardly to the rub rail 13. It should be recognized that the size, shape, and configuration of the appendage 62 impacts the volume of water diverted when the appendage 62 is in the deployed position, and how smoothly that water is diverted. However, the size, shape, and configuration of the appendage 62 may also or alternatively be determined based on the size, shape, and configuration of the hull 2, and/or on the basis of aesthetics.

Figure 9:
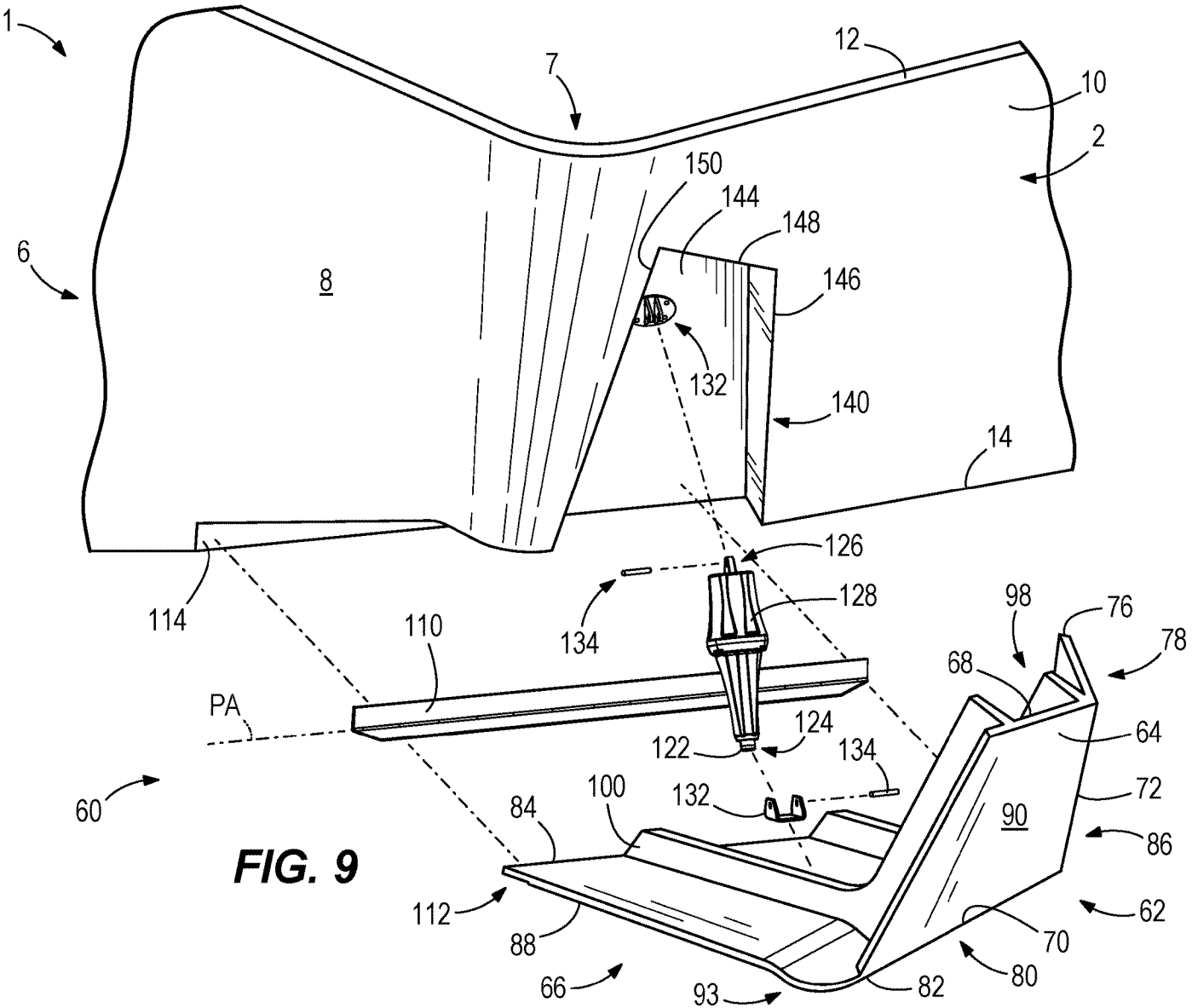
FIG. 9 is an exploded rear perspective view of the device from FIG. 7.

FIG. 9 shows a clevis bracket 132 for coupling the second end 126 of the actuator 120 to the hull 2 via a fastener 134, which as discussed above may be the same clevis bracket 132 and fastener 134 used for coupling the first end 124 of the actuator 120 to the appendage 62. In this embodiment, a recess 140 is provided such that the actuator 120 and at least part of the appendage 62 are positioned within the recess 140 when the appendage 62 is in the stowed position. However, the embodiment of FIG. 9 does not include a cavity that extends further laterally inwardly from the recess 140, in contrast to the cavity 136 shown in FIG. 2. Another difference in the embodiment of FIG. 9 is the rounded transition 93 where the first panel 64 meets the second panel 66, which is in contrast to the hard corner provided as the chine 91 of FIG. 2.

Figure 10:
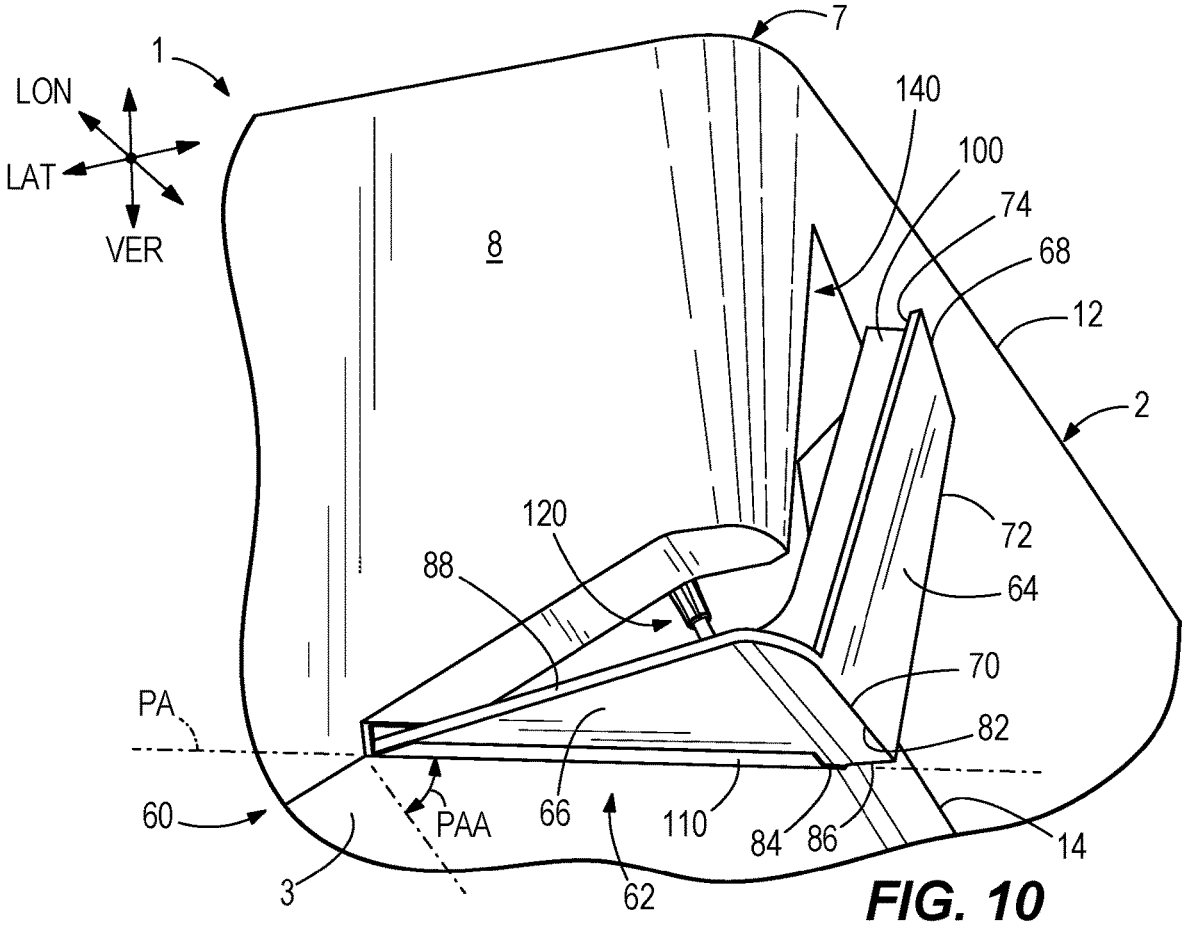
FIG. 10 is a rear perspective view of the device from FIG. 8.
Figure 11:
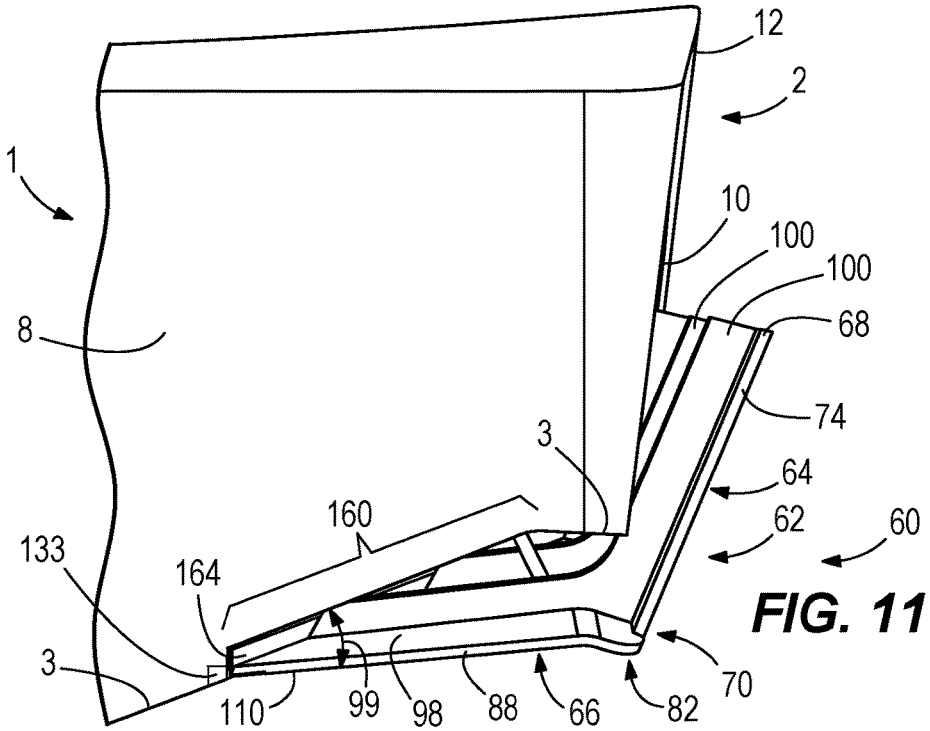
FIG. 11 is a rear view of the device from FIG. 8.

FIGS. 10 and 11 show the appendage 62 pivoted in the deployed position, the second panel 66 having pivoted an angle 99 from the stowed position to the deployed position. As discussed above, the hull 2 and the device 60 may be configured such that the angle 99 between the stowed position and the deployed position is 5 and 50 degrees. FIG. 11 also shows an alternative mechanism for determining the position of the appendage 62, here a rotational sensor 133 operatively coupled between the hull 2 and the appendage 62. By way of example, the rotational sensor 133 may be a rotary potentiometer, a rotary Hall-effect sensor, a rotary inductive position sensor, a rotary variable differential transformer, or a rotary encoder as known in the art (e.g., models R30D RVDT, HSM18 Rotary Hall Effect Sensor, or MRE Single-turn Absolute Rotary Encoder by Althen Sensors of Germany.

Figure 12:
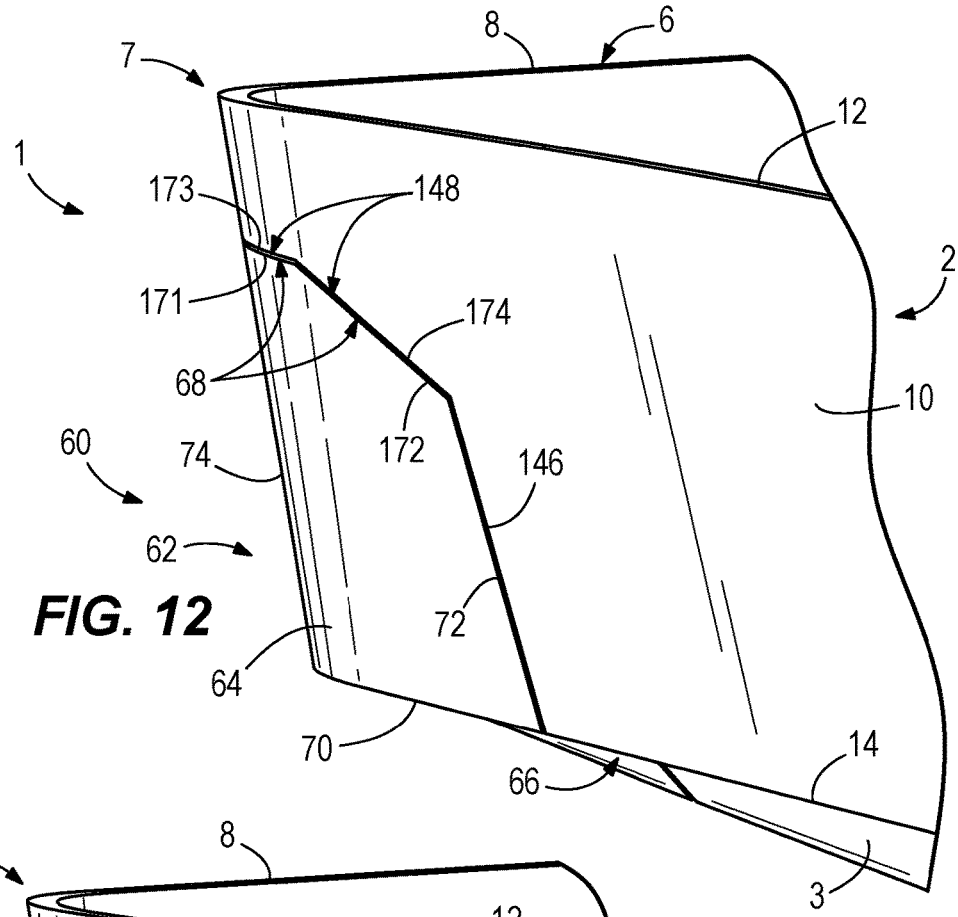
FIG. 12 is a front perspective view of another embodiment of device according to the present disclosure, shown in the stowed position.
Figure 13:
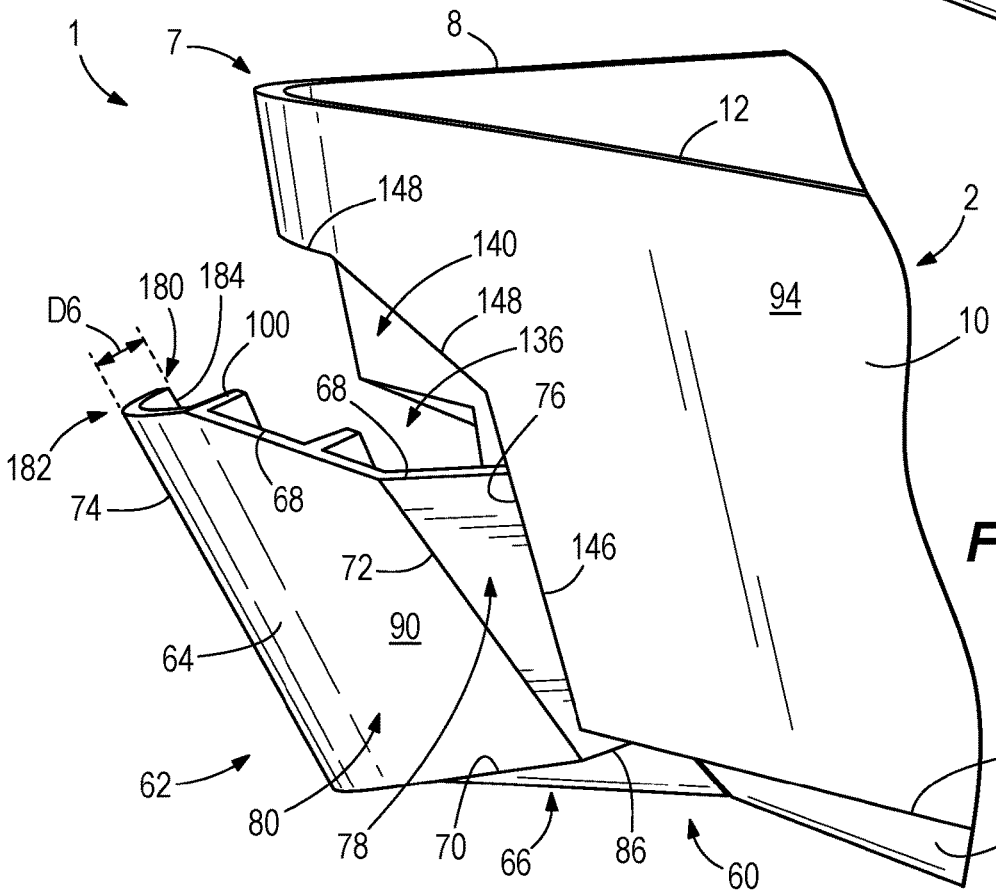
FIG. 13 is a front perspective view of the device from FIG. 12 in the deployed position.

FIGS. 12 and 13 show another embodiment of device 60 according to the present disclosure. For simplicity, the various edges of the first panel 64 and the second panel 66 (as well as the hull 2, the recess 140, the cavity 136, and other elements discussed herein) have been discussed in singular form. These edges need not be simple lines or curves and/or may be divisible into further multiple segments. By way of example, FIGS. 12 and 13 expressly shows the top edge 68 of the first panel 64 being formed by a first segment 171 and a second segment 172, and correspondingly, the top 148 of the recess 140 is formed by a first segment 173 and a second segment 174. Additionally, it should be recognized that the edges shown throughout the present disclosure are merely examples, whereby lines, angles, and curves may be modified to impact the function of the appendage 62 when in the deployed position, to correspond to the shape of the hull 2, and/or for desired aesthetic appeal.

In contrast to the embodiments discussed above, FIGS. 12 and 13 further show the appendage 62 and the recess 140 of the hull 2 wrapping around the aft corner 7 of the hull 2. In particular, the first panel 64 of the appendage 62 includes a third portion 180 that extends from the inner surface 98 of the second edge 74 by a distance D6 to a fourth edge 184 of the first panel 64. The transition 182 from the aft portion 80 to the third portion 180 is shown to be rounded, but other configurations also contemplated by the present disclosure. The transition 182 and third portion 180 may be configured to impact how the water is diverted by the appendage 62, and/or on the basis of aesthetics. In certain embodiments, the present inventor has identified that a square corner for the transition 182 is particularly effective in producing a good, surfable wave.

Figure 14:
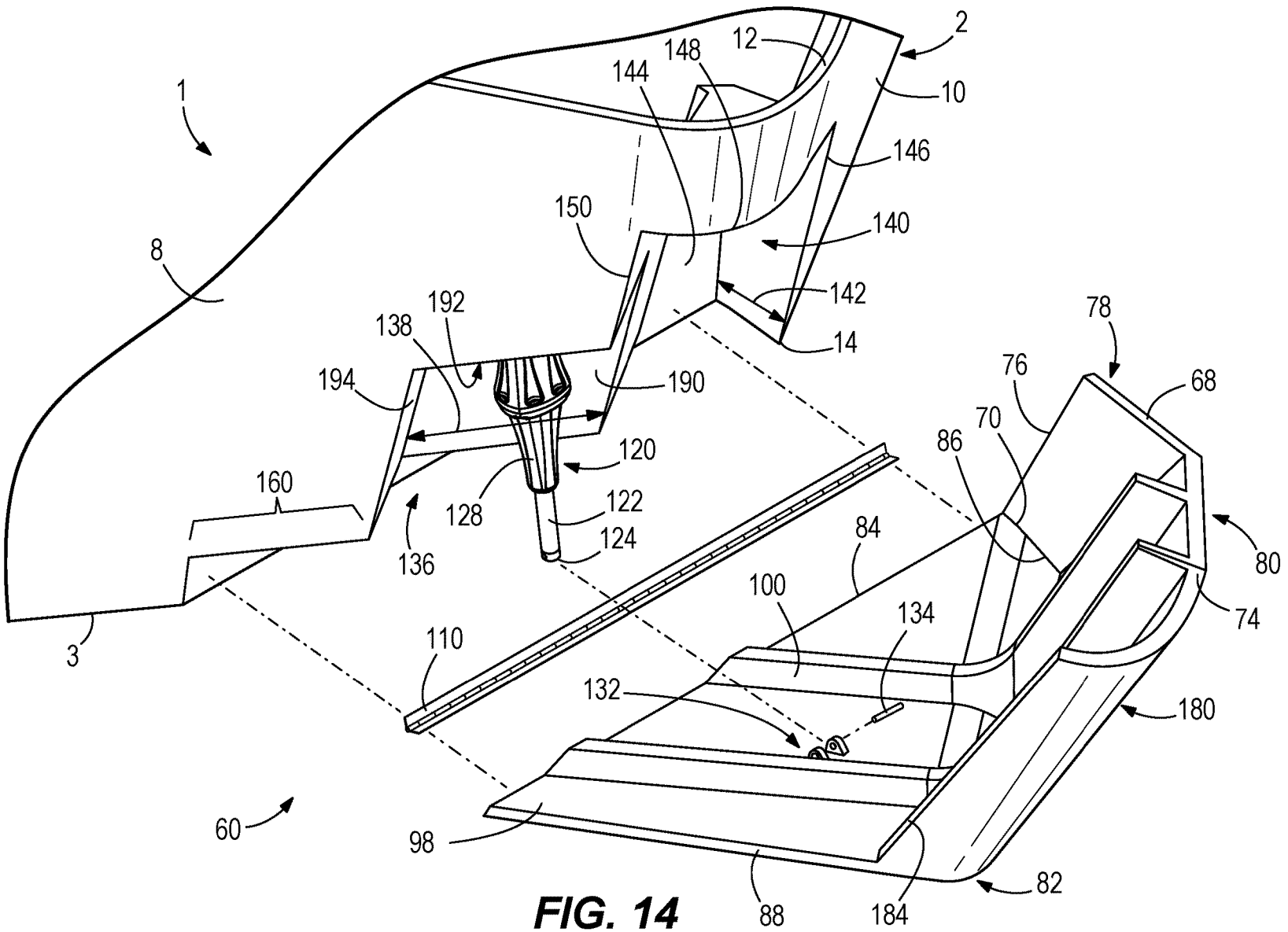
FIG. 14 is an exploded rear perspective view of the device from FIG. 12.
Figure 15:
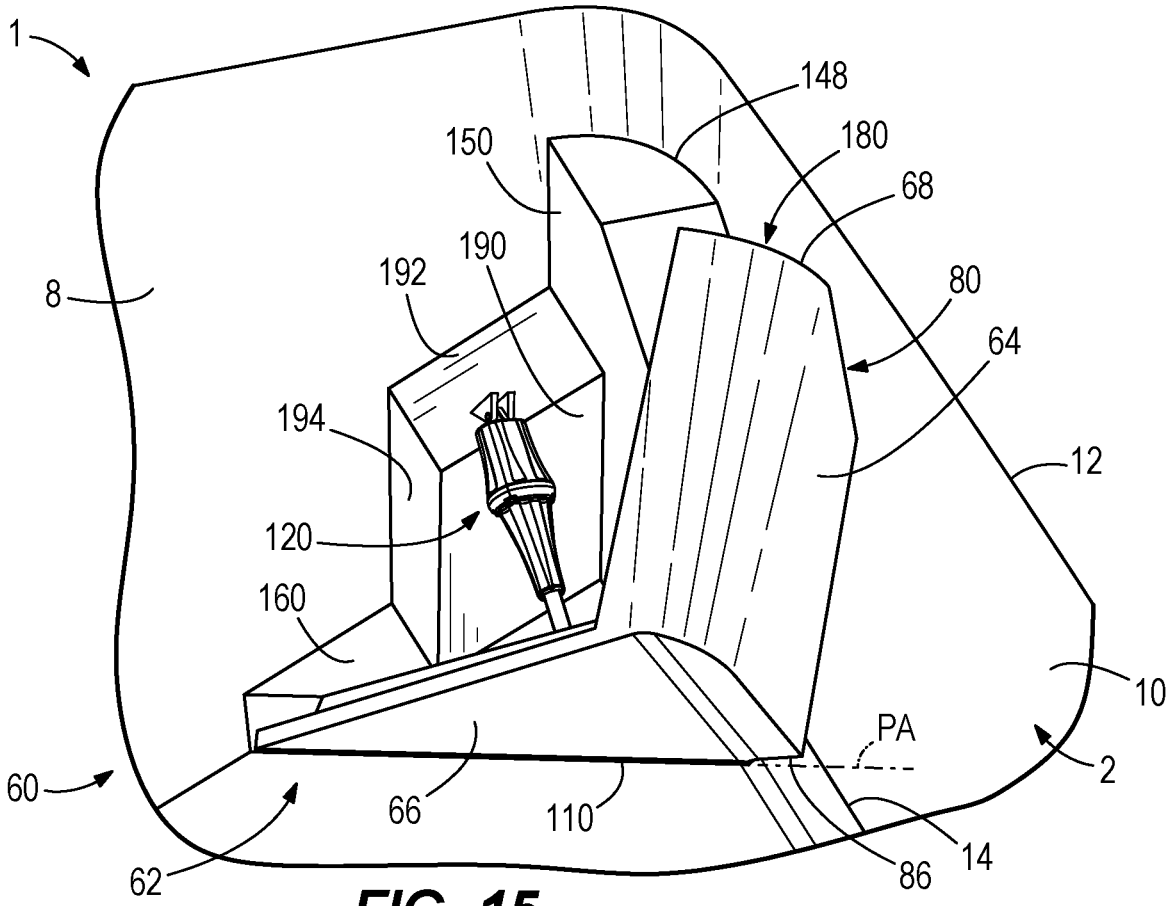
FIG. 15 is a rear perspective view of the device from FIG. 13.
Figure 16:
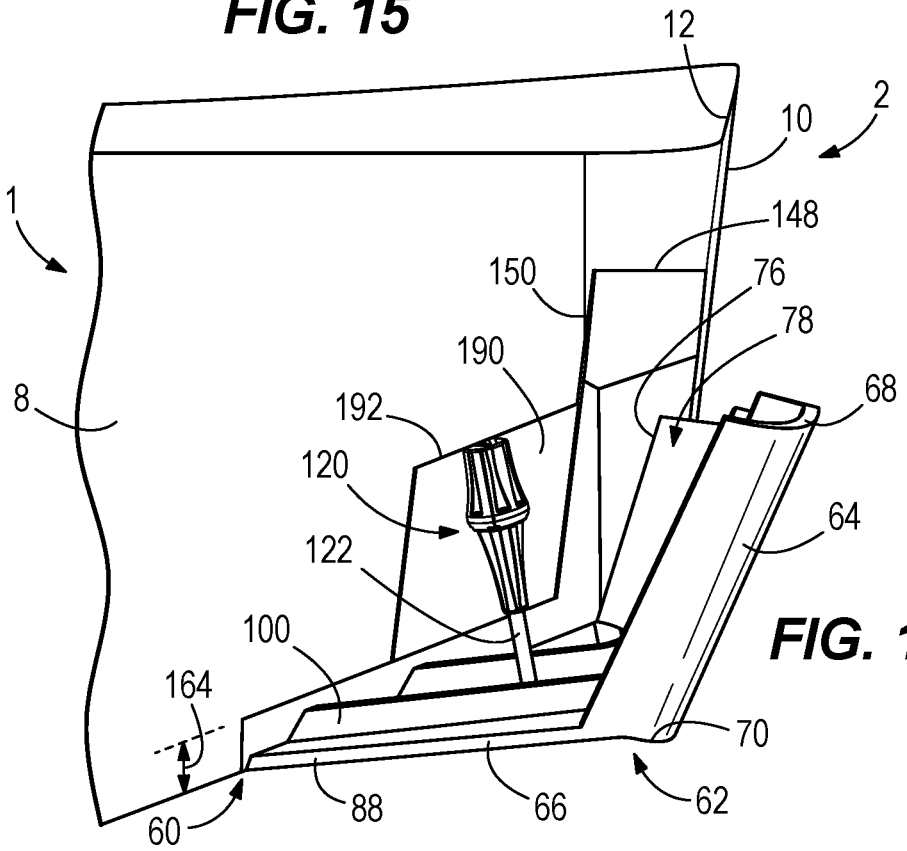
FIG. 16 is a rear view of the device from FIG. 13.

The recess 140 is configured to correspond to the appendage 62, allowing the third portion 180 to also be recessed within the hull 2 when the appendage 62 is in the stowed position. In this manner, the recess 140 wraps around the aft corner 7 and is thus also formed in the transom 8. As shown in FIGS. 14-16, a cavity 136 is also provided in the hull 2 and configured for positioning the actuator 120 therein. In the embodiment shown, the cavity 136 extends to the transom 8, providing access for installation and maintenance. The cavity 136 here is defined between a forward wall 190, top 192, and a base 194, but is otherwise open to the side 10 and the transom 8 of the hull 2.

As with the other embodiments, other types of actuators may be provided as the actuator 120, including rotary actuators. The present disclosure also contemplates configurations in which multiple actuators 120 are coupled between the hull 2 and the appendage 62. For example, two actuators 120 rated for 500 pounds each may be coupled to the hull 2 side by side within the cavity 136 to work in parallel (i.e., rather than one actuator 120 rated for 1000 pounds). The two actuator 120 design provides redundancy in the event of a failure, and also allows the use of actuators with reduced capacities (reducing the size and expense of each actuator).

Figure 17:
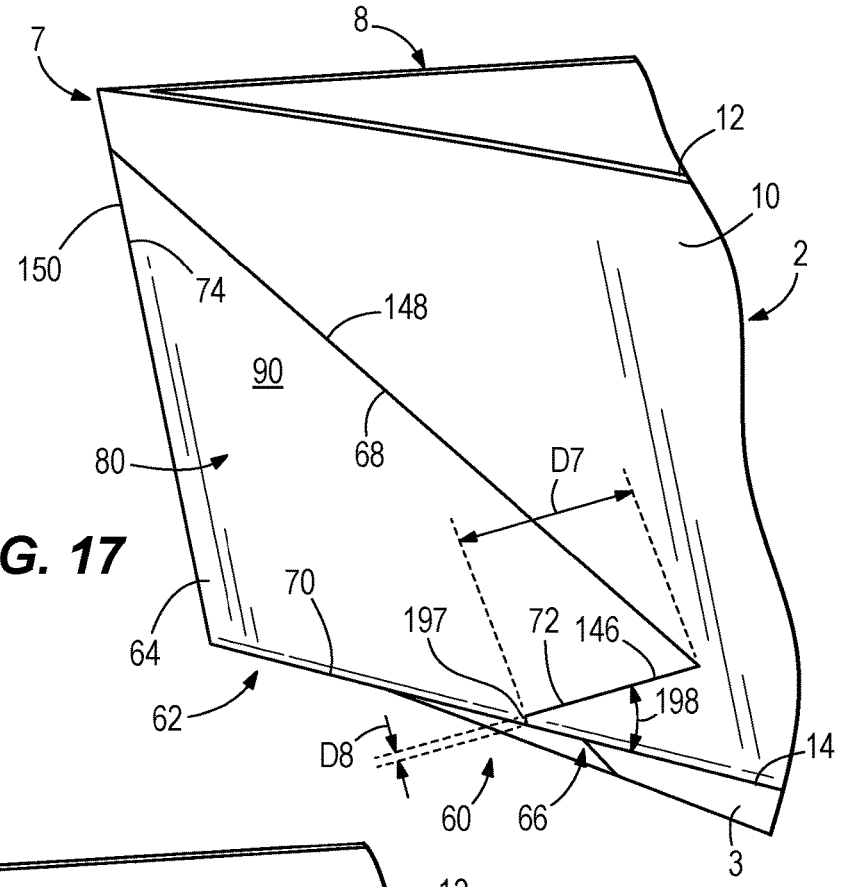
FIG. 17 is a front perspective view of another embodiment of device according to the present disclosure, shown in the stowed position.
Figure 18:
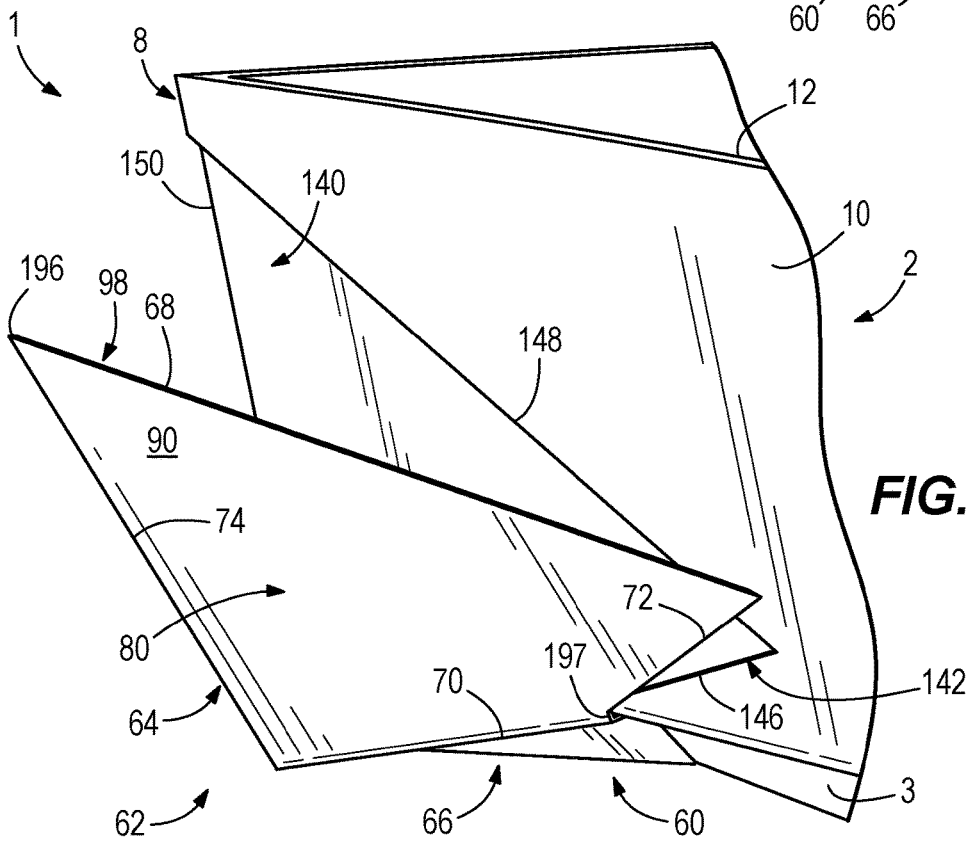
FIG. 18 is a front perspective view of the device from FIG. 17 in the deployed position.
Figure 19:
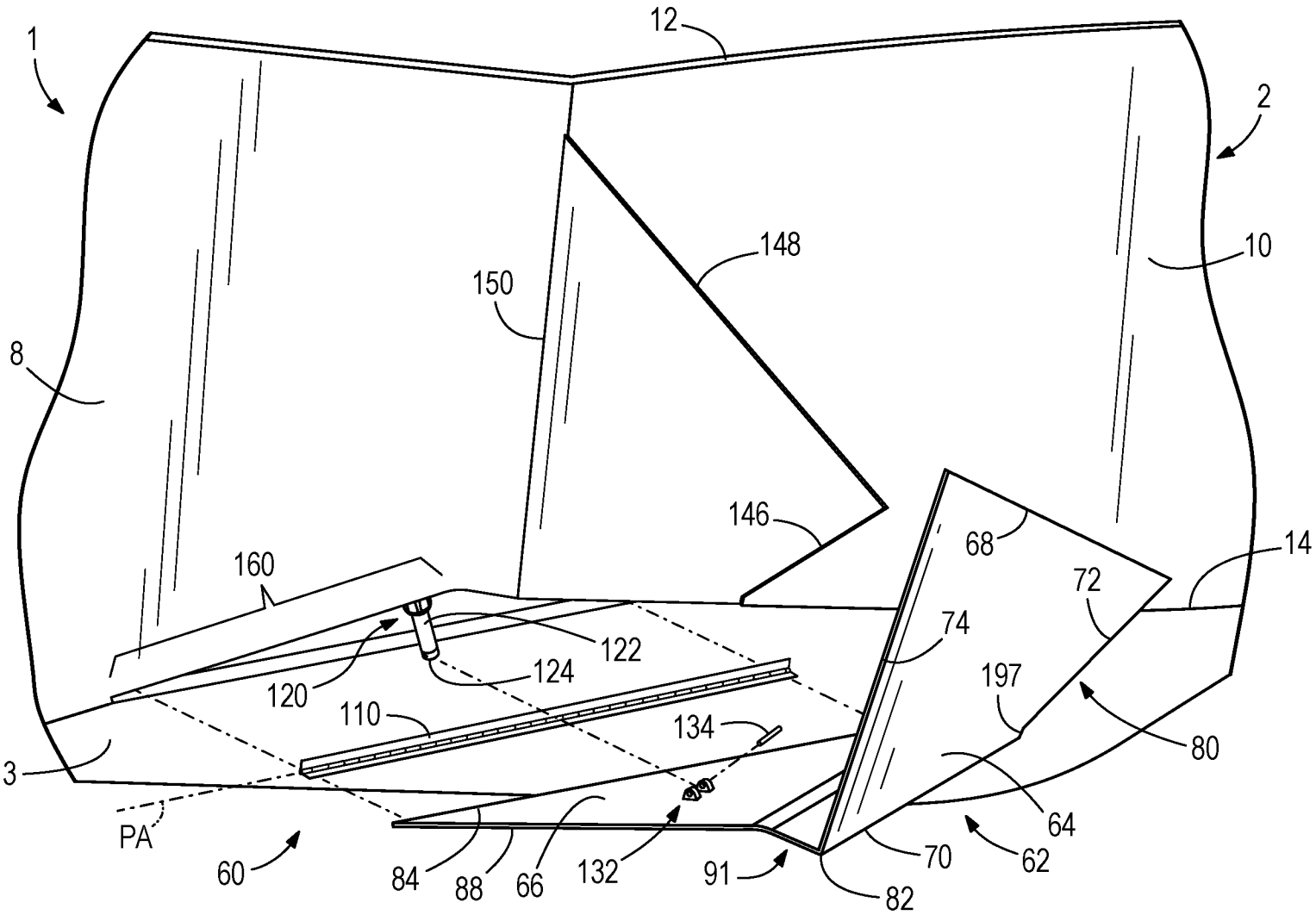
FIG. 19 is an exploded rear perspective view of the device from FIG. 17.

FIGS. 17-19 show another embodiment of device 60 according to the present disclosure. In contrast to the embodiments discussed above, the first panel 64 includes the aft portion 80, but does not have a forward portion 78 that remains at least in part laterally inward of the outer surface 94 of the side 10 of the hull 2 when the appendage is in the deployed position. In this embodiment, the distance 142 in which the recess 140 is recessed into the side 10 of the hull 2 is approximately equal to the thickness 196 between the inner surface 98 and the outer surface 90 of the first panel 64, which here is a constant thickness. The recess 140 extends aftwardly through the transom 8. The recess 160 in the underside 3 also has a depth 162 approximately equal to the thickness 196 of the second panel 66. In this manner, the inner surface 98 of the second panel 66 is approximately flush with the underside 3 of the hull 2 when the appendage is in the stowed position. It should be recognized that no ribs are provided between the first panel 64 and the second panel 66 in this embodiment, though the present disclosure contemplates designs having ribs.

The first edge 72 of the first panel 64 extends farther from the transom 8 than the hinge 110. Consequently, the present inventor has recognized that the side 10 of the hull 2 restrict the movement of the appendage 62 towards the deployed position unless at least a portion of the first edge 72 was angled relative to the bottom edge 70. Through experimentation and development, the present inventor has designed a distance D7 of the first edge 72, the angle 198 between the first edge 72 and the bottom edge 70, and a distance D8 of an offset edge 197 between the bottom edge 70 and the first edge 72 such that the first panel 64 does not prevent the side 10 of the hull 2 from pivoting into the fully deployed position. Additionally, the configuration shown provides that the first edge 72 of the first panel 64 rests upon the side 10 of the hull 2 when the appendage 62 is in the deployed position. This engagement between the first panel 64 and the side 10 prevents water from flowing between them when the marine vessel 1 is underway, which also providing support for the first panel 64. By way of example, the angle 198 may be between 10 and 20 degrees, distance D7 may be between 10 and 25 inches, and the distance D8 may be between 0.5 and 2 inches.

Figure 20:
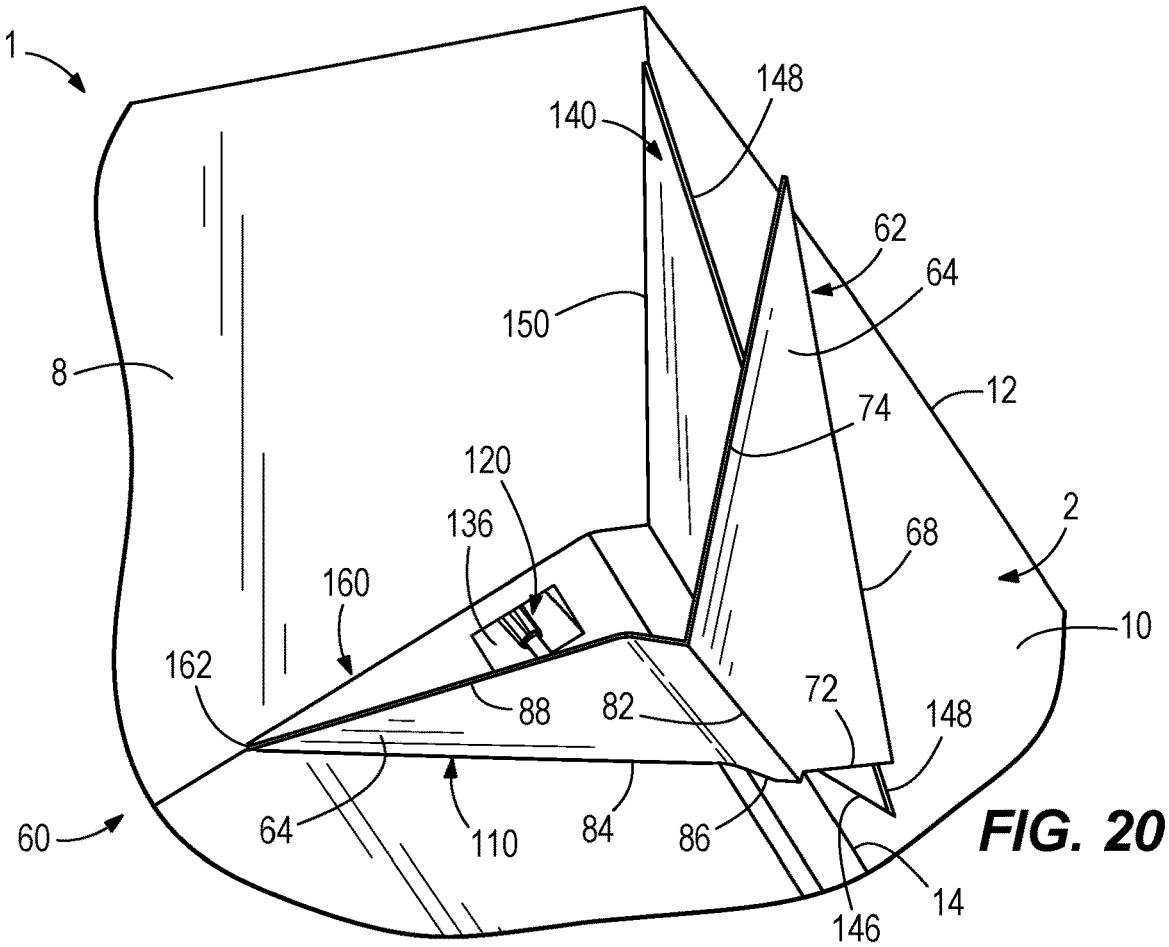
FIG. 20 is a rear perspective view of the device from FIG. 18.
Figure 21:
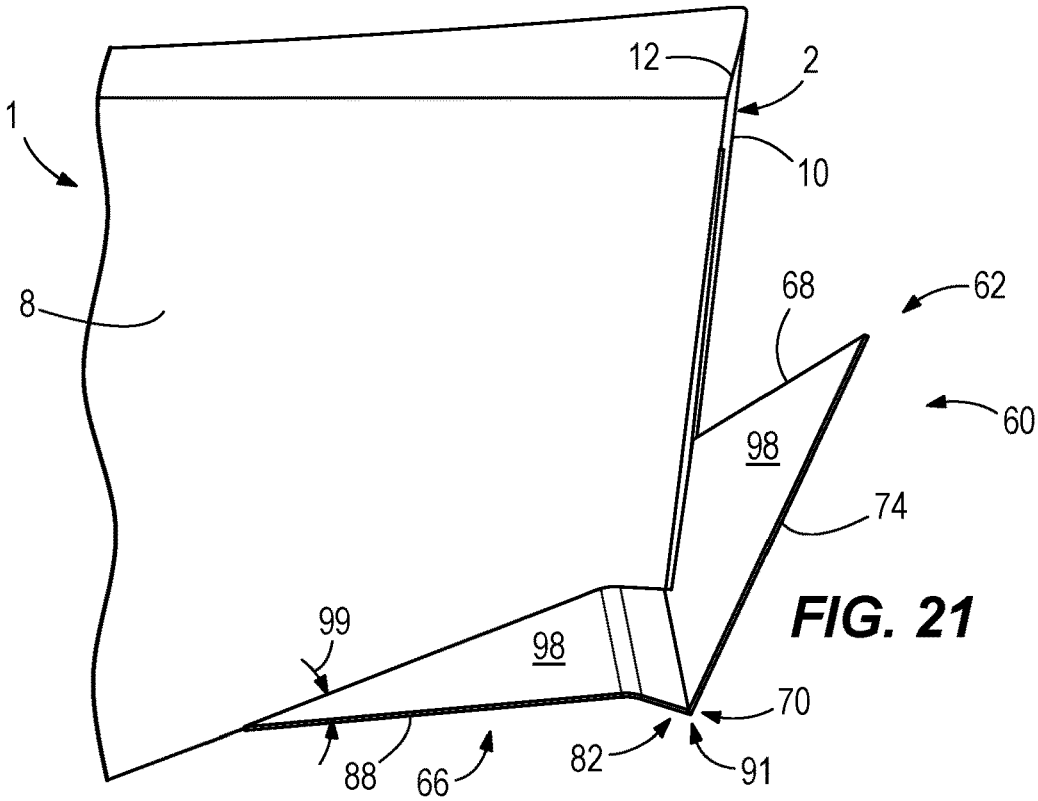
FIG. 21 is a rear view of the device from FIG. 18.

With reference to FIGS. 19-21, the device 60 is further distinct from those discussed above in that the clevis bracket 132 is shown integrally formed onto the inner surface 98 of the second panel 66 of the appendage 62, which is coupled to the actuator 120 in the manner discussed above. Another distinction exists at the other end of the actuator 120, as shown in FIG. 20. Here, the cavity 136 is formed in the underside 3 of the hull 2, rather than in the side 10 as discussed above. The second end 126 of the actuator 120 is coupled to the hull and protected within the cavity 360 in the manner discussed above.

Figure 22:
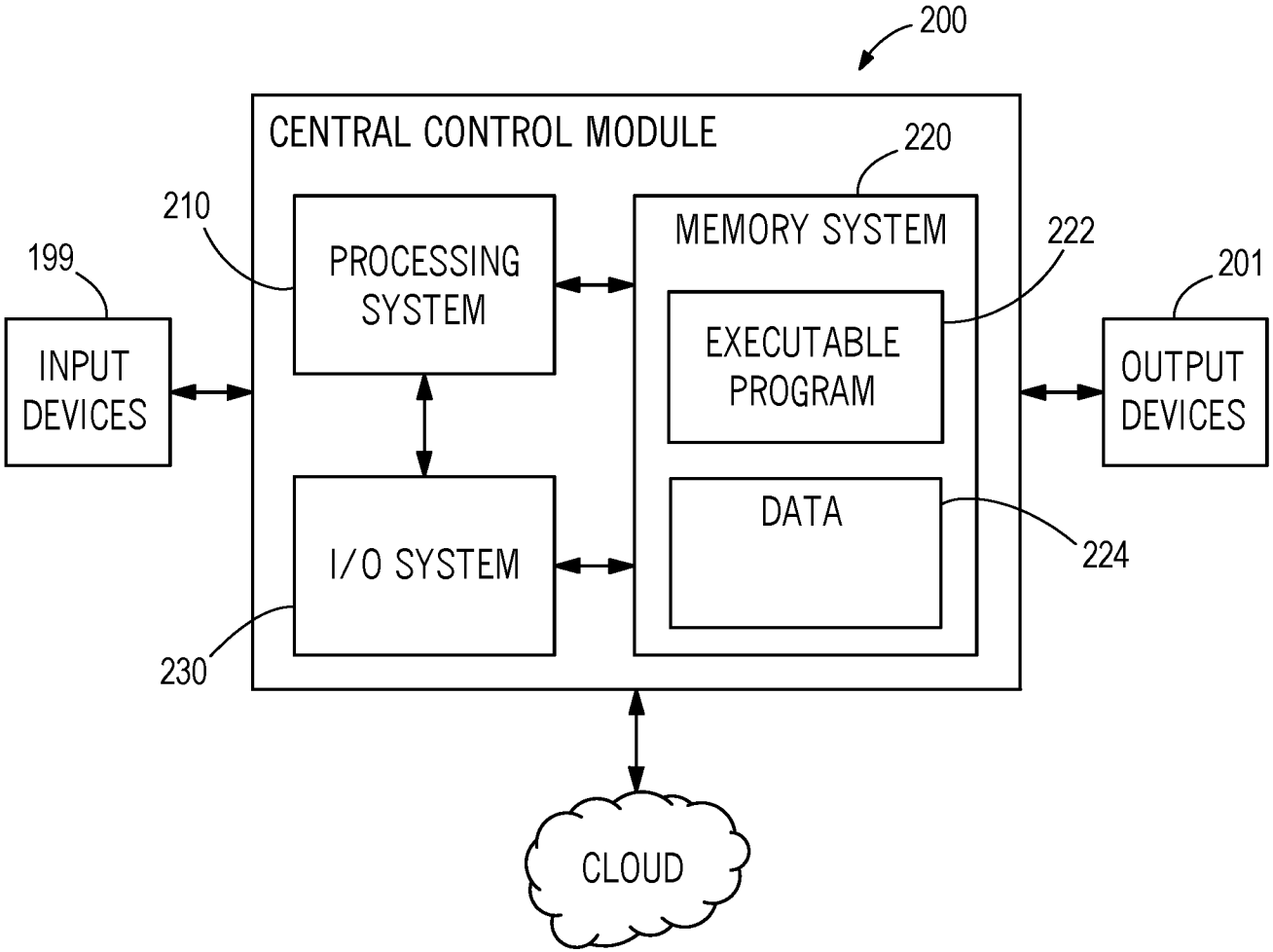
FIG. 22 is a schematic view of a control system for operating devices for modifying a wake according to the present disclosure.

FIG. 22 provides additional information regarding the central control module 32 discussed above, which is part of an overall control system 200. Similar structures shown within the control system 200 may be provided within the helm control module 34 and/or engine control modules 30. The control system 200 includes a processing system 210, which may be implemented as a single microprocessor or other circuitry, or be distributed across multiple processing devices or sub-systems that cooperate to execute the executable program 222 from the memory system 220. Non-limiting examples of the processing system include general purpose central processing units, application specific processors, and logic devices. A person of ordinary skill in the art will recognize that these subsystems may also be present within additional CCMs 32 (as applicable), the HCM 34, and/or engine control modules 30 or other controllers within the marine vessel 1. Multiple control modules are communicatively connected and/or cooperate together to form the control system 200, including the central control module 32, one or more engine control modules 30 each associated with a propulsor 20, and/or other controllers such as engine or motor controllers, etc. However, additional and/or different controllers in alternate configurations may also be considered to be part of the control system 200. Additional information relating to CCMs, ECMs, HCMs, and other elements of control systems is also provided in U.S. Pat. Nos. 9,994,296; 9,975,619; and 10,594,510, which are incorporated by reference herein.

The control system 200 further includes a memory system 220, which may comprise any storage media readable by the processing system 210 and capable of storing the executable program 222 and/or data 224, such as software configured to execute the control methods and the steering maps described herein. The memory system 220 may be implemented as a single storage device or may be distributed across multiple storage devices or sub-systems that cooperate to store computer readable instructions, data structures, program modules, or other data. The memory system 220 may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. Threshold data, including the velocity threshold discussed above for locking out actuation of the actuator, may be stowed in the data 224 of the memory system 220.

An input/output (I/O) system 230 provides communication between the control system 200 and peripheral devices, such as input devices 199 and output devices 201, many of which were discussed further above. Examples of input devices 199 include the engine control modules 30, helm control module 34, powerhead speed sensors 24, encoder 129 of the actuator 120, a magnet 131A and detector 131B of a Hall-effect sensor, and/or a rotational sensor 133. Examples of output devices 201 include the engine control modules 30, and the actuator 120. In practice, the processing system 210 loads and executes an executable program 222 from the memory system 220, accesses data 224 stored within the memory system 220, and directs the marine vessel 1 and the devices 60 to operate as described herein.

A person of ordinary skill in the art will recognize that these subsystems within the control system 200 may be implemented in hardware and/or software that carries out a programmed set of instructions. As used herein, the term "controller" or "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. One or more central control module 32 may together constitute a control system 200.

A person of ordinary skill in the art will understand in light of the disclosure that the control system 200 may include a differing set of one or more control modules, or control devices, which may include engine control modules 30 for each propulsor 20, one or more thrust vector control modules (TVMs), one or more helm control modules 34, and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

The control system 200, and/or each of the control modules therein, communicates with each of one or more components on the marine vessel 1 via a communication link CL, which can be any wired or wireless link. The illustrated communication link CL connections between functional and logical block components are merely exemplary, which may be direct or indirect, and may follow alternate pathways. The control system 200 is capable of receiving information and/or controlling one or more operational characteristics of devices 60 and various sub-systems by sending and receiving control signals via the communication links CL. In one embodiment, the communication link CL is a controller area network (CAN) bus, such as a CAN Kingdom network; however, other types of links could be used which may utilize wired or wireless communication means. It will be recognized that the extent of connections and the communication links CL may in fact be one or more shared connections, or links, among some or all of the components in the marine vessel 1. Moreover, the communication link CL lines are meant only to demonstrate that the various control elements are capable of communicating with one another, and do not represent actual wiring connections between the various elements, nor do they represent the only paths of communication between the elements. Additionally, the marine vessel 1 may incorporate various types of communication devices and systems, and thus the illustrated communication links CL may in fact represent various types of wireless and/or wired data communication systems. It will be recognized that the arrows shown are merely exemplary and that communication may flow in multiple directions.

Through experimentation and development, the present inventor has recognized additional benefits for incorporating additional safety features into the devices 60 disclosed herein. For example, attempting to move the appendage 62 into from the deployed position while the marine vessel 1 is moving at a fast velocity can generate extreme forces on the actuator 120 during operation. Accordingly, the HCM 34 (FIG. 1) and/or central control module 32 may be configured to "lock-out" operation of the actuator 120 when the marine vessel 1 is moving at a velocity exceeding a predetermined threshold (e.g., 5 mph, or idle RPM). The velocity may be inferred from the RPM of the powerheads 22 as measured by the powerhead speed sensors 24, by GPS, or by other methods presently known in the art (e.g., a pitot tube). The lock-out may also be active whenever a Surf Mode is enabled in the CCM 32. For example, the system may require the user to enable a Surf Mode to add ballast or actuate the device 60 to ensure no operation is done when the marine vessel is already underway. Additionally, the present inventor has recognized that in certain configurations it is beneficial to prevent the devices 60 on each side of the marine vessel from being deployed at the same time.

Returning to FIG. 1, the present inventor has recognized that coupling the appendage 62 to the underside 3 of the hull 2, rather than to the transom 8 as presently known, prevents interference with the propulsors 20, and with likewise inboard motors, stern drives, rudders, or traditional trim tabs mounted on the transom. Additionally, the presently disclosed devices 60 allow a greater number of propulsors to be positioned at the stern 6 that possible when surf tabs presently known in the art, which extend longitudinally rearwardly from the transom 8. The devices 60 disclosed herein offer a robust design for selectively generating wake in which the actuators (e.g., actuator 120) are protected from the elements, and the appendage 62 effectively disappears into the side 10 of the hull 2 when not in use. This provides an aesthetically pleasing design for the operator, as well minimizing drag and protecting the various components from contact and fouling.

In certain embodiments according to the present disclosure, the appendage 62 is approximately even in the longitudinal direction with the transom 8 (at least in the deployed position). The present inventor has identified that this configuration results in very little spray from the appendage 62, advantageously providing a cleaner flow of water for the propeller.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A device for modifying a wake of a marine vessel having a hull, the hull extending between a bow and a transom in a longitudinal direction and between sides in a lateral direction perpendicular to the longitudinal direction, the sides each extending between a top and a bottom in a vertical direction that is perpendicular to the longitudinal direction and perpendicular to the lateral direction, wherein an underside of the hull extends between the sides and between the bow and the transom, the device comprising:

an appendage having a first panel and a second panel, the first panel being fixed relative to the second panel, the appendage configured to be movably coupled to the hull and movable into and between a stowed position and a deployed position such that in the stowed position the first panel extends along one of the sides of the hull and the second panel extends along the underside of the hull, and the first panel moves laterally outwardly away from the one of the sides of the hull and the second panel moves vertically away from the underside of the hull when the appendage moves toward the deployed position, in particular so that moving the appendage from the stowed position to the deployed position causes the appendage to modify the wake of the marine vessel;

wherein the first panel comprises a top edge opposite a bottom edge, the first panel being coupled to the second panel at the bottom edge, and wherein the top edge moves farther from the hull than the bottom edge moves from the hull when the appendage is moved from the stowed position to the deployed position.

2. The device according to claim 1, wherein the appendage is pivotally coupled to the underside of the hull.

3. The device according to claim 1, wherein the appendage pivots between 10 and 30 degrees between the stowed position and the deployed position.

4. The device according to claim 1, further comprising an actuator operable to pivot the appendage into and between the stowed position and the deployed position, wherein the actuator is positioned entirely longitudinally forward of the transom.

5. The device according to claim 4, wherein the actuator is a linear actuator.

6. The device according to claim 1, wherein the first panel comprises a forward portion and an aft portion, the aft portion being longitudinally closer than the forward portion to the transom when the appendage is in the stowed position, wherein the forward portion angles laterally inwardly towards the hull relative when the appendage is in the stowed position.

7. The device according to claim 6, wherein each of the sides of the hull have an outer surface, wherein the first panel is configured such that the forward portion is at least partially positioned laterally inward relative to the outer surface of the one of the sides of the hull when the appendage is in the deployed position so as to divert water laterally away from the one of the sides of the hull when the marine vessel is underway.

8. The device according to claim 1, wherein the first panel comprises a top edge opposite a bottom edge, the first panel being coupled to the second panel at the bottom edge, wherein the top edge angles vertically downwardly and longitudinally towards the bow when the appendage is in the stowed position.

9. The device according to claim 1, wherein the first panel comprises an aft edge and an opposite forward edge with a bottom edge therebetween, the first panel being coupled to the second panel at the bottom edge and the aft edge being closer than the forward edge to the transom when the appendage is in the stowed position, wherein the forward edge angles vertically downwardly and longitudinally towards the transom when the appendage is in the stowed position so as to avoid contact with the one of the sides of the hull when the appendage moves toward the deployed position.

10. The device according to claim 1, wherein the hull includes a chine between the underside and the side, and wherein the first panel vertically extends at least 7 inches above the chine when the appendage is in the stowed position.

11. The device according to claim 1, wherein the hull includes chine sections between the underside and the sides, respectively, and wherein the appendage further includes an intermediate panel between the first panel and the second panel such that when the appendage is in the stowed position the intermediate panel longitudinally extends along one of the chine sections.

12. A device for modifying a wake of a marine vessel having a hull, the hull extending between a bow and a transom in a longitudinal direction and between sides in a lateral direction perpendicular to the longitudinal direction, the sides each extending between a top and a bottom in a vertical direction that is perpendicular to the longitudinal direction and perpendicular to the lateral direction, wherein an underside of the hull extends between the sides and between the bow and the transom, the device comprising an appendage having a first panel and a second panel, the first panel being fixed relative to the second panel, the appendage configured to be movably coupled to the underside of the hull and movable into and between a stowed position and a deployed position such that in the stowed position the first panel extends along one of the sides of the hull and the second panel extends along the underside of the hull, and the first panel moves laterally outwardly away from the one of the sides of the hull and the second panel moves vertically away from the underside of the hull when the appendage moves toward the deployed position, in particular so that moving the appendage from the stowed position to the deployed position causes the appendage to modify the wake of the marine vessel, wherein a centerline laterally bisects the marine vessel between the bow and the transom, and wherein the appendage pivots about a pivot axis that extends non-parallel and non-perpendicular to centerline such that pivoting the appendage towards the deployed position simultaneously causes the first panel to move laterally outwardly away from the one of the sides of the hull and the second panel to move vertically away from the underside of the hull.

13. The device according to claim 12, wherein the pivot axis extends at an angle between 35 and 55 degrees from the centerline.

14. A device for modifying a wake of a marine vessel having a hull, the hull extending between a bow and a transom in a longitudinal direction and between sides in a lateral direction perpendicular to the longitudinal direction, the sides each extending between a top and a bottom in a vertical direction that is perpendicular to the longitudinal direction and perpendicular to the lateral direction, wherein an underside of the hull extends between the sides and between the bow and the transom, the device comprising:

an appendage having a first panel and a second panel, the first panel being fixed relative to the second panel; and an actuator operable to pivot the appendage into and between a stowed position and a deployed position, wherein in the stowed position the first panel extends along one of the sides of the hull and the second panel extends along the underside of the hull, and the first panel moves laterally outwardly away from the one of the sides of the hull and the second panel moves vertically away from the underside of the hull when the appendage moves toward the deployed position, in particular so that moving the appendage from the stowed position to the deployed position causes the appendage to modify the wake of the marine vessel;

wherein a cavity is formed in the hull, and wherein the actuator is positioned within the cavity such that the actuator is hidden by the appendage when in the stowed position.

15. The device according to claim 14, wherein the cavity is open to the underside of the hull.

16. A device for modifying a wake of a marine vessel having a hull, the hull extending between a bow and a transom in a longitudinal direction and between sides in a lateral direction perpendicular to the longitudinal direction, the sides each extending between a top and a bottom in a vertical direction that is perpendicular to the longitudinal direction and perpendicular to the lateral direction, wherein an underside of the hull extends between the sides and between the bow and the transom, the device comprising an appendage having a first panel and a second panel, the first panel being fixed relative to the second panel, the appendage configured to be movably coupled to the hull and movable into and between a stowed position and a deployed position such that in the stowed position the first panel extends along one of the sides of the hull and the second panel extends along the underside of the hull, and the first panel moves laterally outwardly away from the one of the sides of the hull and the second panel moves vertically away from the underside of the hull when the appendage moves toward the deployed position, in particular so that moving the appendage from the stowed position to the deployed position causes the appendage to modify the wake of the marine vessel, wherein a recess is formed in one of the sides of the hull, and wherein the first panel is at least partially positioned in the recess in the one of the sides of the hull when the appendage is in the stowed position.

17. The device according to claim 16, wherein each of the sides of the hull have an outer surface, and wherein the first panel is flush with the outer surface of the one of the sides when the appendage is in the stowed position.

18. The device according to claim 16, further comprising one or more ribs coupled to the first panel and to the second panel to prevent flexion therebetween, wherein the one or more ribs are position in the recess within the one of the sides of the hull when the appendage is in the stowed position.

19. The device according to claim 16, wherein a recess is also formed in the underside of the hull, and wherein the second panel is at least partially received within the recess in the underside of the hull when in the stowed position.

20. A marine vessel having a modifiable wake, the marine vessel comprising:

a hull, the hull extending between a bow and a transom in a longitudinal direction and between sides in a lateral direction perpendicular to the longitudinal direction, the sides each extending between a top and a bottom in a vertical direction that is perpendicular to the longitudinal direction and perpendicular to the lateral direction, wherein an underside of the hull extends between the sides and between the bow and the transom;

an appendage having a first panel and a second panel, the first panel being fixed relative to the second panel, and the appendage being pivotally coupled to the hull;

an actuator operable to pivot the appendage about a pivot axis into and between a stowed position and a deployed position, wherein in the stowed position the first panel extends along one of the sides of the hull and the second panel extends along the underside of the hull, wherein a centerline laterally bisects the hull between the bow and the transom, and wherein the pivot axis extends at an angle between 35 and 55 degrees from the centerline such that the first panel moves laterally outwardly away from the one of the sides of the hull and the second panel moves vertically away from the underside of the hull when the appendage moves toward the deployed position, in particular so that moving the appendage from the stowed position to the deployed position causes the appendage to modify the wake of the marine vessel;

wherein the actuator is at least partially positioned longitudinally forward of the transom, wherein recesses are formed in the one of the sides and in the underside of the hull, and wherein the appendage is configured such that the first panel and the second panel are each at least partially positioned in the recesses in the one of the sides and in the underside, respectively, when in the stowed position.

* * * * *